US007444087B2

(12) United States Patent
Ishii

(10) Patent No.: US 7,444,087 B2
(45) Date of Patent: Oct. 28, 2008

(54) IMAGE FORMING APPARATUS AND DEVELOPER CARTRIDGE WITH POWER SUPPLY SHIELDING MECHANISM

(75) Inventor: Masahiro Ishii, Nagoya (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 468 days.

(21) Appl. No.: 11/335,517

(22) Filed: Jan. 20, 2006

(65) Prior Publication Data

US 2006/0177230 A1 Aug. 10, 2006

(30) Foreign Application Priority Data

Jan. 20, 2005 (JP) ..... 2005-013179

(51) Int. Cl.
*G03G 15/00* (2006.01)

(52) U.S. Cl. ..... 399/24; 399/27; 399/119

(58) Field of Classification Search ..... 399/12, 399/24, 25, 27, 29, 37, 43, 55, 119
See application file for complete search history.

(56) References Cited

U.S. PATENT DOCUMENTS 4,956,668 A * 9/1990 Arnold et al. ..... 399/59
5,021,828 A * 6/1991 Yamaguchi et al. ..... 399/24
5,155,527 A * 10/1992 Gokita et al. ..... 399/29
5,758,224 A * 5/1998 Binder et al. ..... 399/25
5,835,817 A * 11/1998 Bullock et al. ..... 399/25
6,215,966 B1 * 4/2001 Yang et al. ..... 399/27
6,246,854 B1 6/2001 Kurosawa et al.
6,512,896 B2 1/2003 Asanuma et al.
6,647,213 B2 * 11/2003 Takeda ..... 399/12
7,139,492 B2 * 11/2006 Mitamura ..... 399/12
7,263,300 B2 * 8/2007 Ishii et al. ..... 399/27

FOREIGN PATENT DOCUMENTS

JP 3-225381 4/1991
JP 3-230182 10/1991
JP 08179614 A * 7/1996
JP 8-220880 8/1996
JP 11258968 A * 9/1999
JP 2000-293024 10/2000
JP 2001-337568 12/2001

* cited by examiner

*Primary Examiner*—Robert Beatty
(74) *Attorney, Agent, or Firm*—McDermott Will & Emery LLP

(57) ABSTRACT

A CPU causes a power control unit and a bias application circuit at all times to apply a developing bias to a developing roller thereby to execute a printing operation. When the CPU determines the lapse of lifetime of a developer cartridge on the basis of detection signals from a toner shortage detecting sensor and a counter, the CPU detects that the developer cartridge is at a spaced position, and causes the power control unit to feed a fusing current from the bias application circuit thereby to fuse a fuse element.

10 Claims, 22 Drawing Sheets

IMAGE FORMING APPARATUS AND DEVELOPER CARTRIDGE WITH POWER SUPPLY SHIELDING MECHANISM

CROSS REFERENCE TO RELATED APPLICATION

This application claims priority from Japanese Patent Application No. 2005-013179 filed on Jan. 20, 2005, the entire subject matter of which is incorporated herein by reference.

TECHNICAL FIELD

The present invention may relate to an image forming apparatus and a developer cartridge.

BACKGROUND

Generally, an image forming apparatus has a toner cartridge removably mounted for reserving a toner. When the toner residue in a toner cartridge becomes less than a predetermined quantity, for example, the toner may not be sufficiently transferred to the recorded medium thereby to cause the so-called "faint printing". When the toner in the toner cartridge is degraded (in the charging performance), it may not be transferred to the proper position on the recorded medium thereby to cause the so-called "printing fog".

In view of the above problem, there is disclosed in JP-A-2001-337568 an image forming apparatus for deciding the timing for exchanging the toner cartridge. Specifically, the image forming apparatus measures the lapse of time for the toner supply from the instant when a new toner cartridge was mounted in the image forming apparatus body, and inhibits the recording operation (or the image forming operation) by assuming the arrival of the exchanging time.

The old cartridge having been removed for the arrival of the exchanging time may be stored in the office at the same place of a new toner cartridge till it is discarded, and may be mounted again in another image forming apparatus body of the same kind. In the image forming apparatus disclosed in JP-A-2001-337568, the exchanging time is determined on the basis of the lapse of the toner supply time from the instant when the old toner cartridge was newly mounted. Therefore, the recording operation may be permitted to cause the insufficient image formation highly probably. In short, the configuration disclosed in JP-A-2001-337568 can decide the exchanging timing properly, in case the new toner cartridge is mounted, but cannot in case the toner cartridge mounted was once used. As a result, the recording operation is executed with the used toner cartridge thereby to cause the poor image formation.

SUMMARY

One aspect of the present invention may provide an image forming apparatus and a developer cartridge, which may prevent an image of a poor quality from being formed even if a developer cartridge having an exhausted lifetime is reused.

An image forming apparatus includes: an image forming apparatus body that forms image on a recording medium; and a developer cartridge that is removably mounted on the image forming apparatus body. The developer cartridge includes: a developer reserving chamber that reserves a developing agent; a developing side electrode that is configured to be applied with a developing bias; a developer carrier that carries a developing agent in the developer reserving chamber to an image carrier when the developing bias applied to the developing side electrode is received; and a power supply shielding mechanism that electrically connects the developing side electrode and the developer carrier and shields the power supply between the developing side electrode and the developer carrier by an irreversible shielding operation. The image forming apparatus body includes: a determination unit that determines whether or not a lifetime of the developer cartridge is elapsed; an application unit that applies the developing bias to the developing side electrode; and an execution unit that causes the power supply shielding mechanism to execute the shielding operation when the determination unit determines that the lifetime of the developer cartridge is elapsed.

A developer cartridge is to be removably mounted on an image forming apparatus body of an image forming apparatus, and includes: a developer reserving chamber that reserves a developing agent; a developing side electrode that is configured to be applied with a developing bias; a developer carrier that carries a developing agent in the developer reserving chamber to an image carrier when the developing bias applied to the developing side electrode is received; and a power supply shielding mechanism that electrically connects the developing side electrode and the developer carrier and shields the power supply between the developing side electrode and the developer carrier by an irreversible shielding operation. The power supply shielding mechanism performs the shielding operation when determined by the image forming apparatus body that a lifetime of the developer cartridge is elapsed.

BRIEF DESCRIPTION OF THE DRAWINGS

In the accompanying drawings:

FIGS. 14A and 14B show sectional views of an essential portion and showing the relations between the states of the levers and the cams of the laser printer and a position sensor, wherein FIG. 14A shows the state (i.e., the contact starting state) of the levers and the cams, and FIG. 14B shows the state of a position sensor (i.e., the shield starting state by a shielding portion);

FIGS. 15A and 15B show sectional views of an essential portion and showing the relations between the states of the levers and the cams of the laser printer and a position sensor, wherein FIG. 15A shows the state (i.e., the contact ending state) of the levers and the cams, and FIG. 15B shows the state of a position sensor (i.e., the shield ending state by a shielding portion);

DETAILED DESCRIPTION

Illustrative aspects will be described below with reference to the drawings.

First Illustrative Aspect

A first illustrative aspect is described with reference to FIG. 1 to FIG. 21.

Entire Structure of Laser Printer

Figure 1:
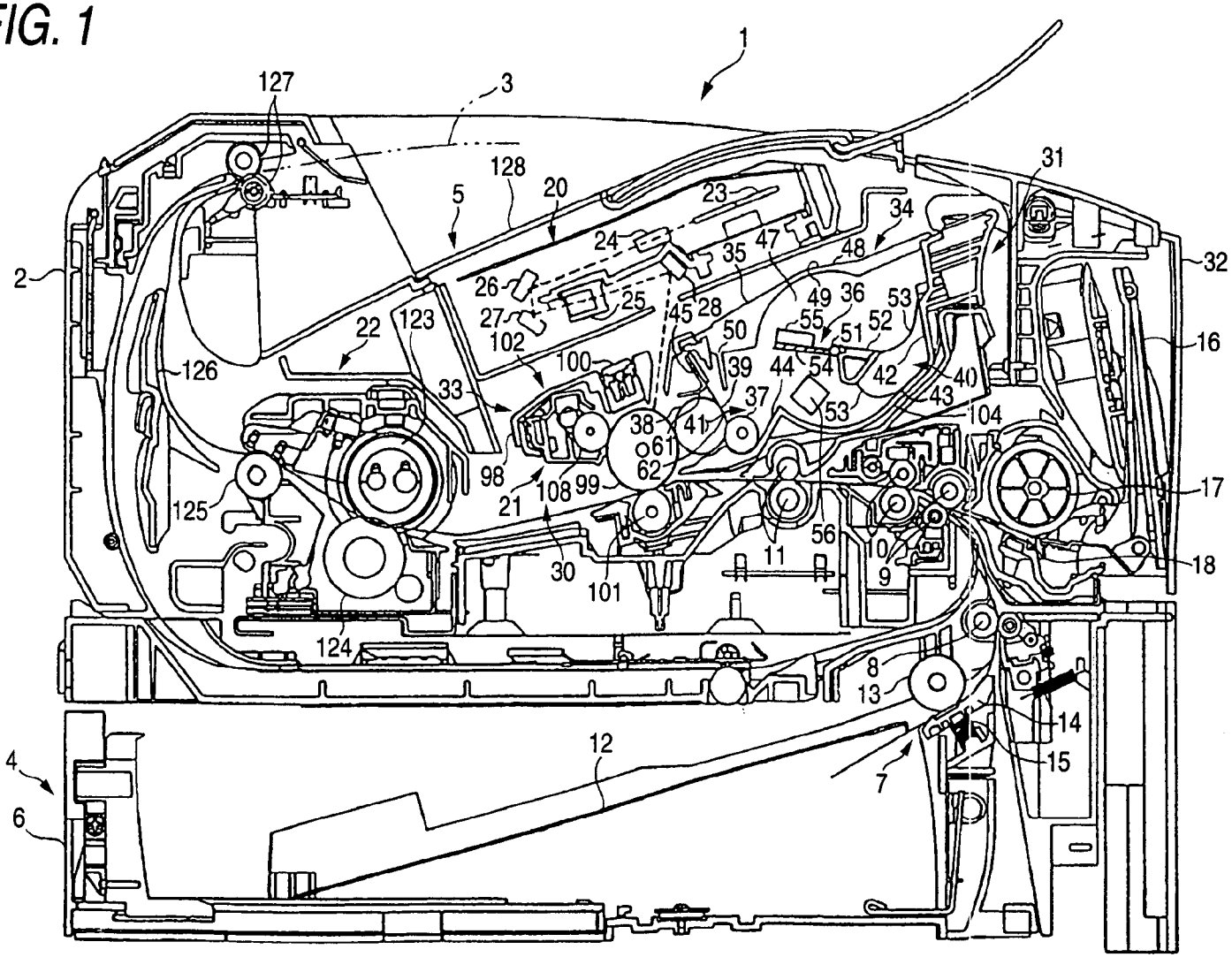
FIG. 1 is a sectional view showing a laser printer according to a first illustrative aspect.

FIG. 1 is a sectional view of an essential side showing a laser printer as an image forming apparatus according to the first illustrative aspect. In FIG. 1, the laser printer 1 is provided in a body frame 2 with a feeder unit 4 for feeding a sheet 3 as a recording medium, and an image forming unit 5 for forming an image on a sheet 3 fed.

(1) Feeder Unit

The feeder unit 4 is equipped with: a sheet feed tray 6 disposed in the bottom portion of the body frame 2; a sheet feeding mechanism 7 disposed at one end portion (which will be called the front side whereas the opposite side will be called the back side) of the sheet feed tray 6; transfer rollers 8, 9 and 10 disposed on the downstream side of the transfer direction of the sheet 3 with respect of the sheet feeding mechanism 7; and a resist roller 11 disposed on the downstream side of the transfer direction of the sheet 3 with respect to those transfer rollers 8, 9 and 10.

(a) Sheet Feed Tray

The sheet feed tray 6 is formed in a box shape having its upper face opened for accommodating sheets 3 in a stacked shape, and can be removably mounted in a horizontal direction on the bottom portion of the body frame 2. In this sheet feed tray 6, there is disposed a sheet pressure plate 12. This sheet pressure plate 12 can stack the sheets 3 in the laminar state and is rockably supported at the end portion farther from the sheet feeding mechanism 7 that its end portion closer to the sheet feeding mechanism 7 can vertically move. Below the sheet pressure plate 12, there is disposed the not-shown spring, by which the sheet pressure plate 12 is biased upward. As the stacked number of sheets 3 increases, therefore, the sheet pressure plate 12 is rocked downward on the end portion farther from the sheet feeding mechanism 7 against the biasing force of the spring.

(b) Sheet Feeding Mechanism

The sheet feeding mechanism 7 is equipped with a sheet feed roller 13, a separator pad 14 opposed to the sheet feed roller 13, and a spring 15 arranged on the back side of the separator pad 14. In the sheet feeding mechanism 7, the separator pad 14 is pushed toward the sheet feed roller 13 by the biasing force of the spring 15.

When the sheet pressure plate 12 is biased upward by the spring, the uppermost sheet 3 on the sheet pressure plate 12 is pushed toward the sheet feed roller 13. As the sheet feed roller 13 rotates, the front end of the sheet 3 is clamped between the sheet feed roller 13 and the separator pad 14 so that the sheets 3 are separated one by one by the cooperation of the sheet feed roller 13 and the separator pad 14. The sheet 3 thus separated is transferred to the resist roller 11 by the transfer rollers 8, 9 and 10.

The resist roller 11 is composed of a pair of rollers to transfer the sheet 3, while correcting the oblique run, to an image forming position (i.e., the contact portion between a photosensitive drum 99 and a transfer roller 101, as will be described hereinafter).

Here, the feeder unit 4 of this laser printer 1 is further equipped with: a multipurpose tray 16 for stacking the sheets 3 of an arbitrary size; a multipurpose sheet feed roller 17 for feeding the sheets 3 stacked on the multipurpose tray 16; a multipurpose separator pad 18 opposed to the multipurpose sheet feed roller 17. The multipurpose tray 16 is housed in a folded state in a front cover 32.

(2) Image Forming Unit

The image forming unit 5 is equipped with a scanner unit 20, a process unit 21 and a fixing unit 22.

(a) Scanner Unit

The scanner unit 20 is disposed at the upper portion in the body frame 2 and is equipped with a laser light emitting unit (although not shown), a rotationally driven polygon mirror 23, lenses 24 and 25 and reflecting mirrors 26, 27 and 28. From the laser emitting unit, there is emitted the laser beam which is modulated on the basis of print data expressing an image to be formed on the sheet 3. This laser beam is passed through or reflected by the polygon mirror 23, the lens 24, the reflecting mirrors 26 and 27, the lens 25 and the reflecting mirror 28 sequentially in the recited order, as indicated by chained lines, so that it irradiates the surface of the photosensitive drum 99 of the process unit 21, as will be described hereinafter.

(b) Process Unit

Figure 2:
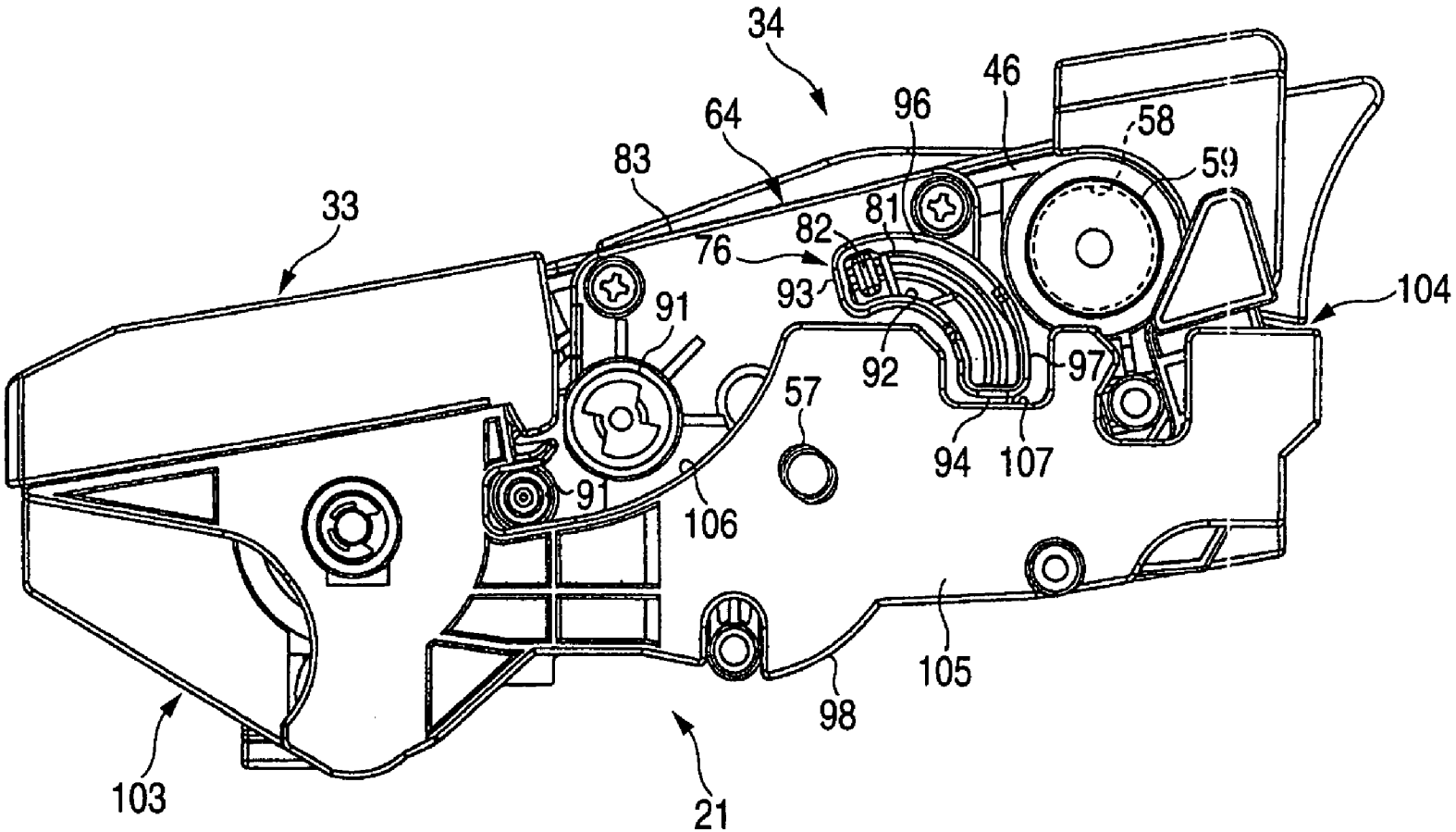
FIG. 2 is a side elevation showing a process unit.
Figure 3:
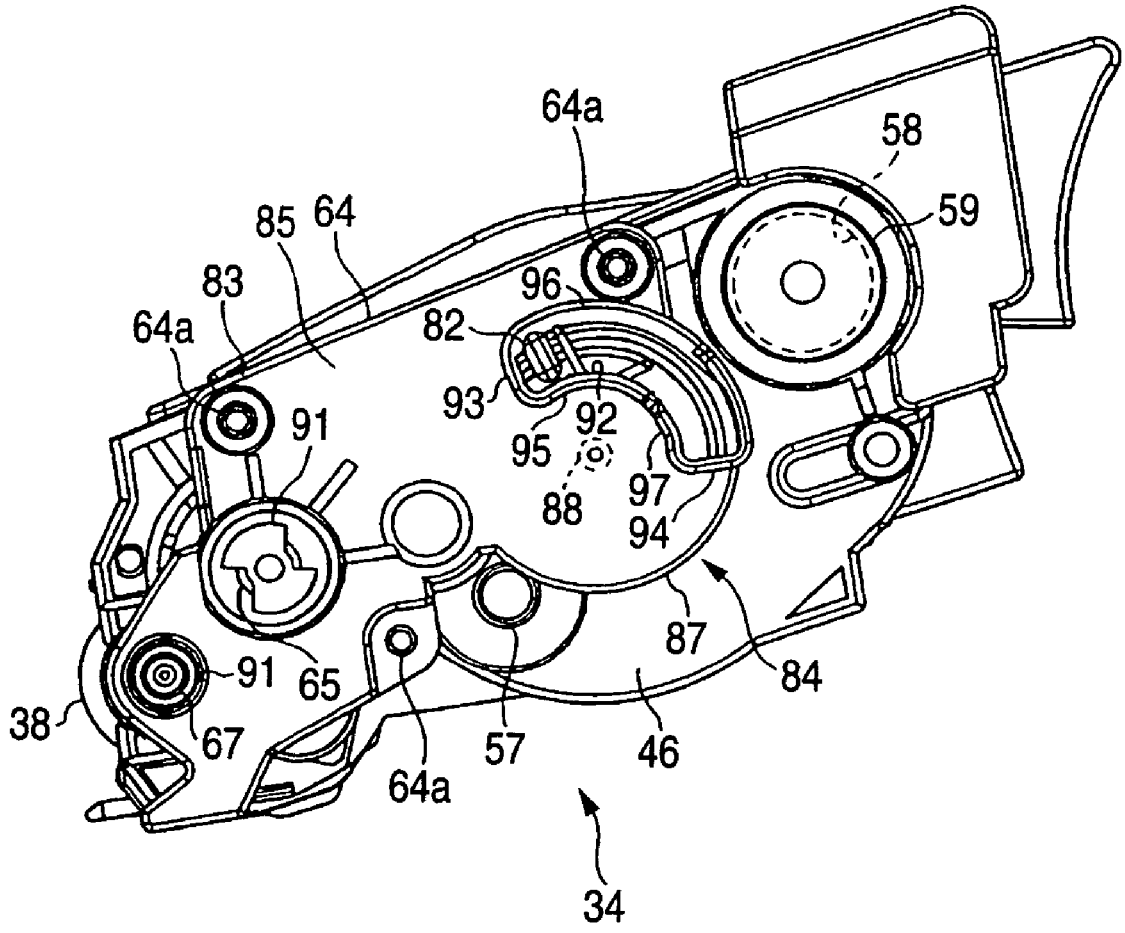
FIG. 3 is a side elevation showing a developer cartridge (a detection gear: at a new product position)
Figure 4:
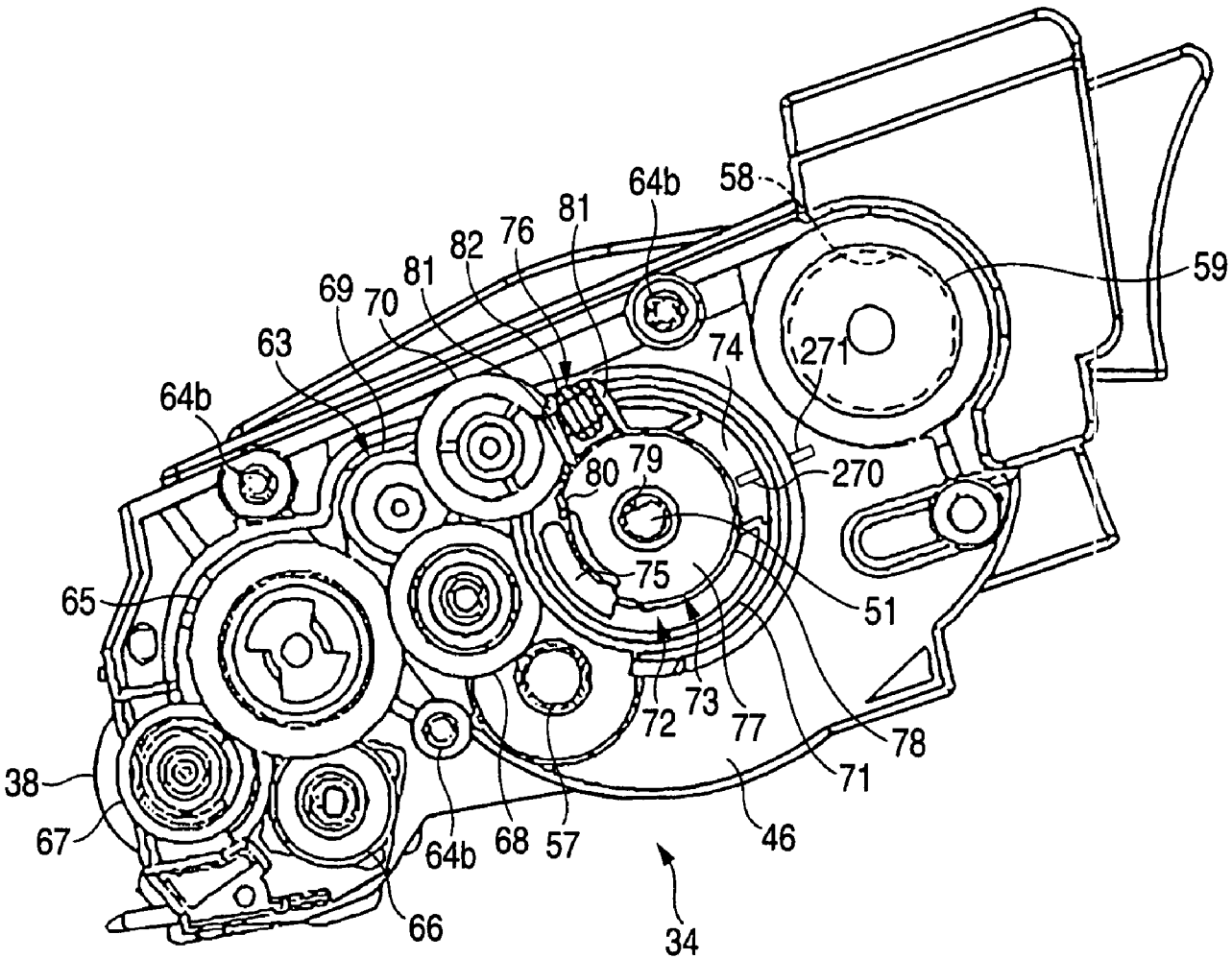
FIG. 4 is a side elevation showing the developer cartridge having its cover member removed.
Figure 5:
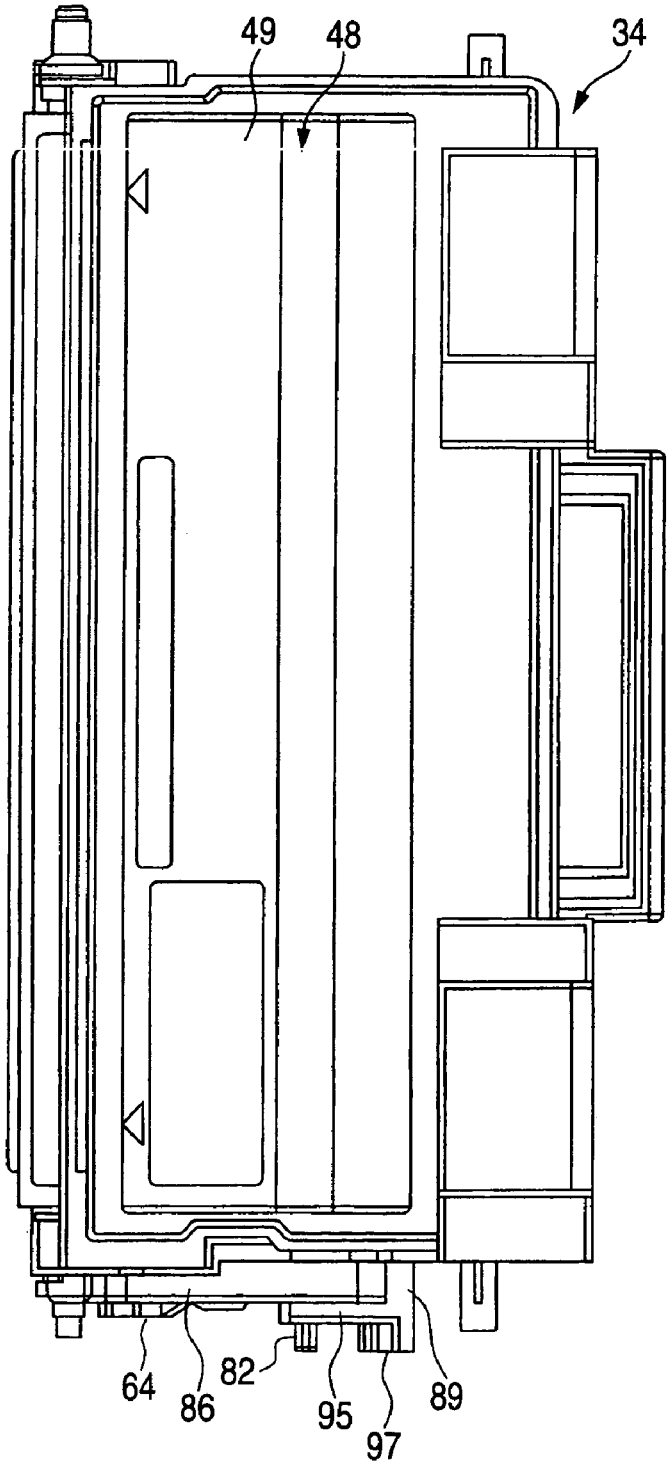
FIG. 5 is a top plan view of the developer cartridge.
Figure 6:
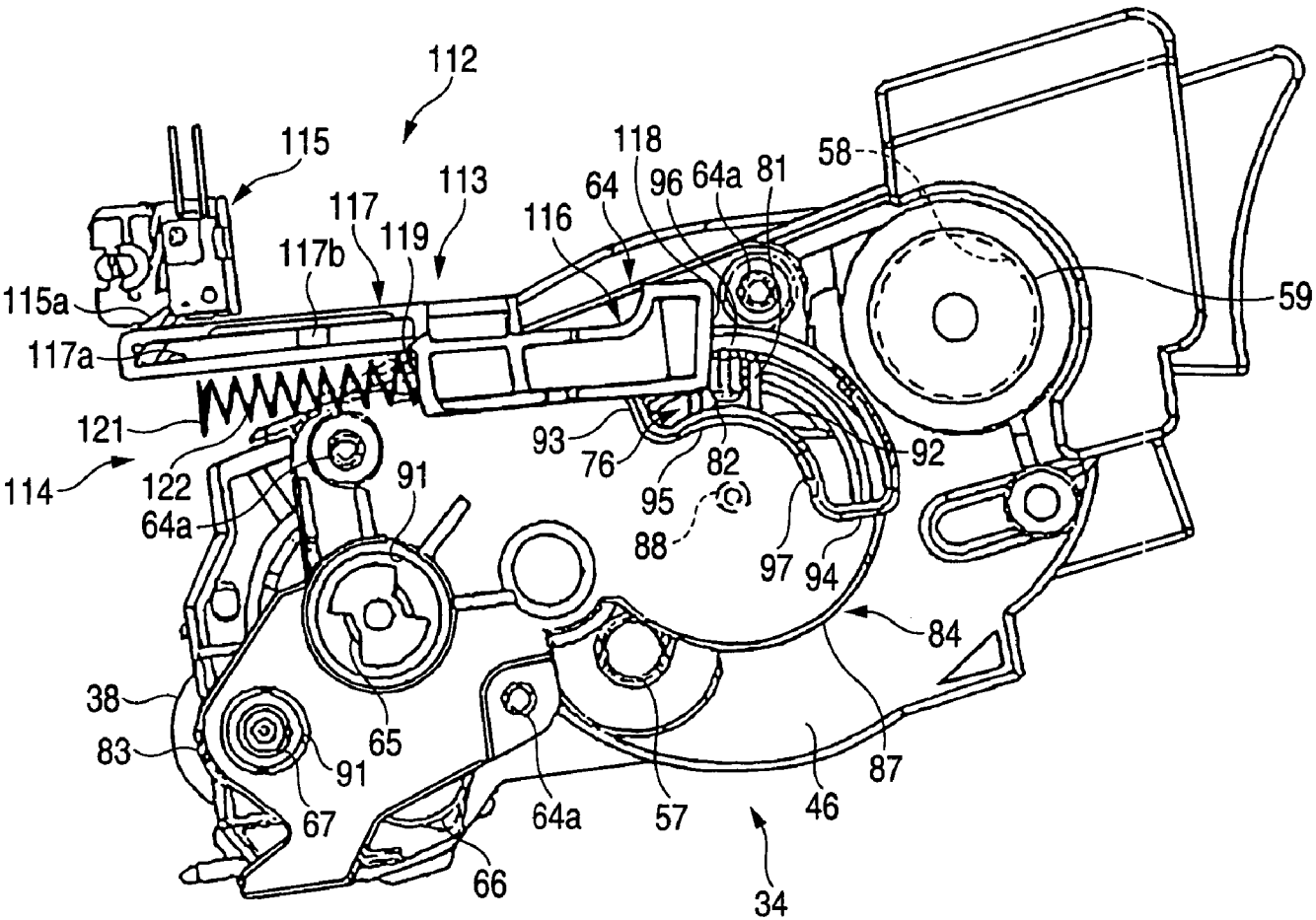
FIG. 6 is a side elevation of the developer cartridge of the process unit (the detection gear: at a power transmission position)
Figure 7:
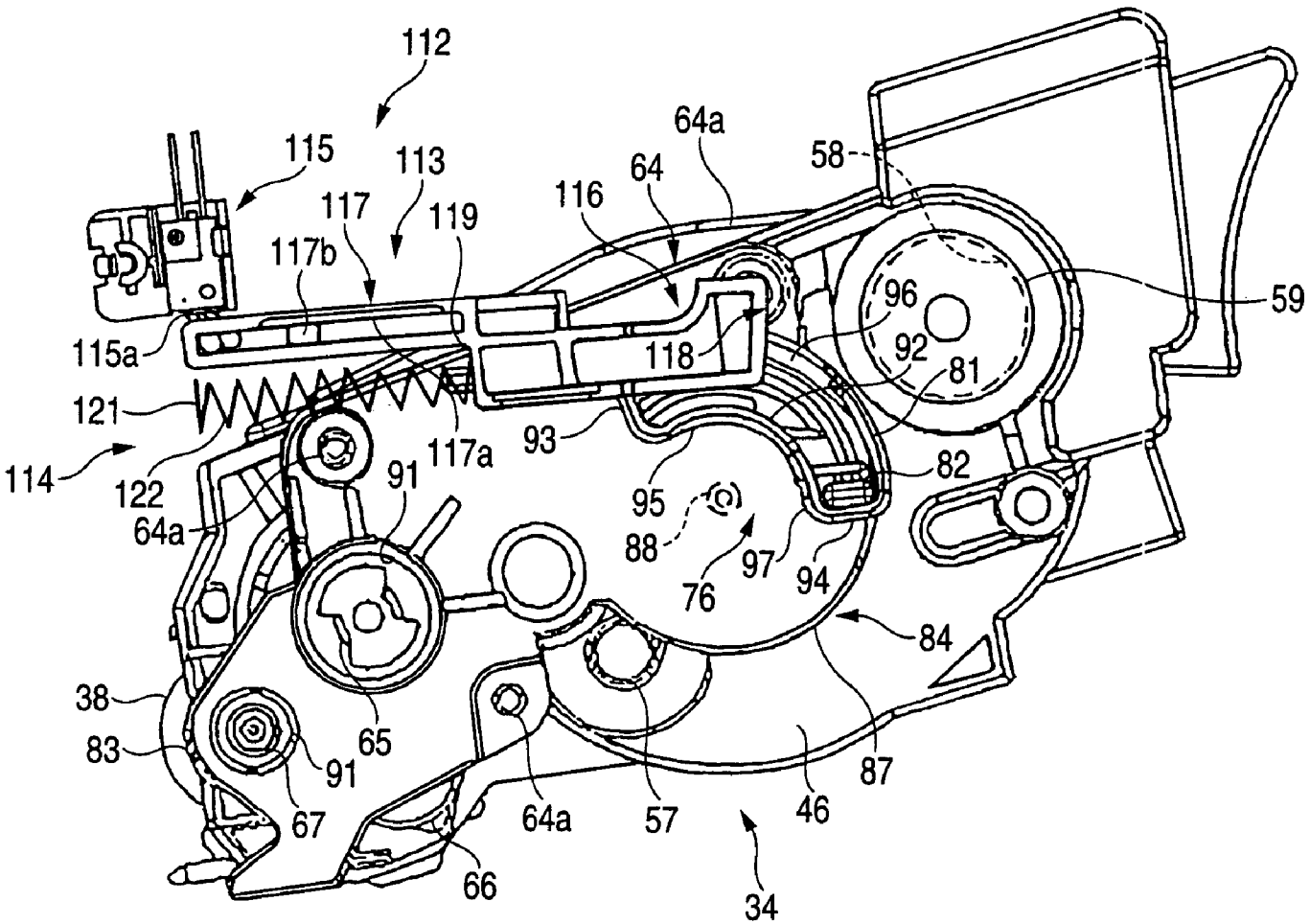
FIG. 7 is a side elevation showing the state, in which the cover member of the developer cartridge is removed.
Figure 8:
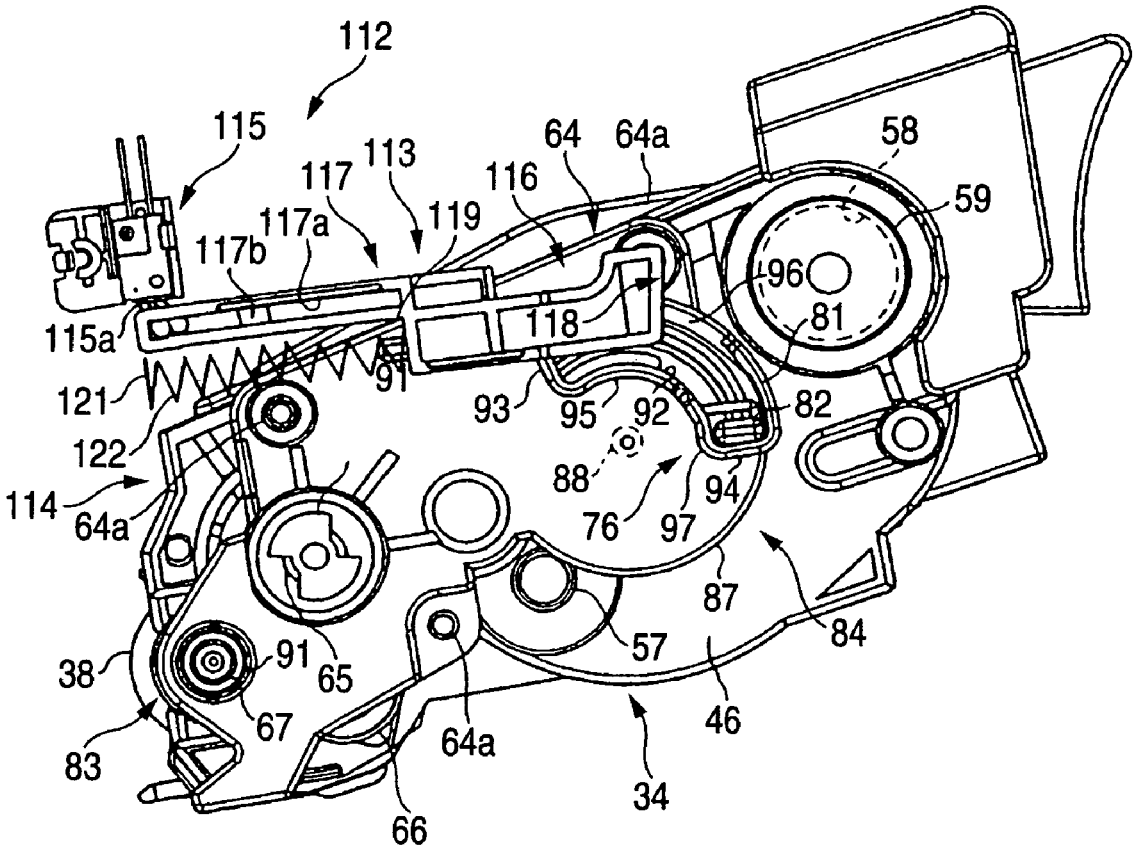
FIG. 8 is a side elevation showing the developer cartridge of the developer cartridge (the detection gear: at an old product position)
Figure 9:
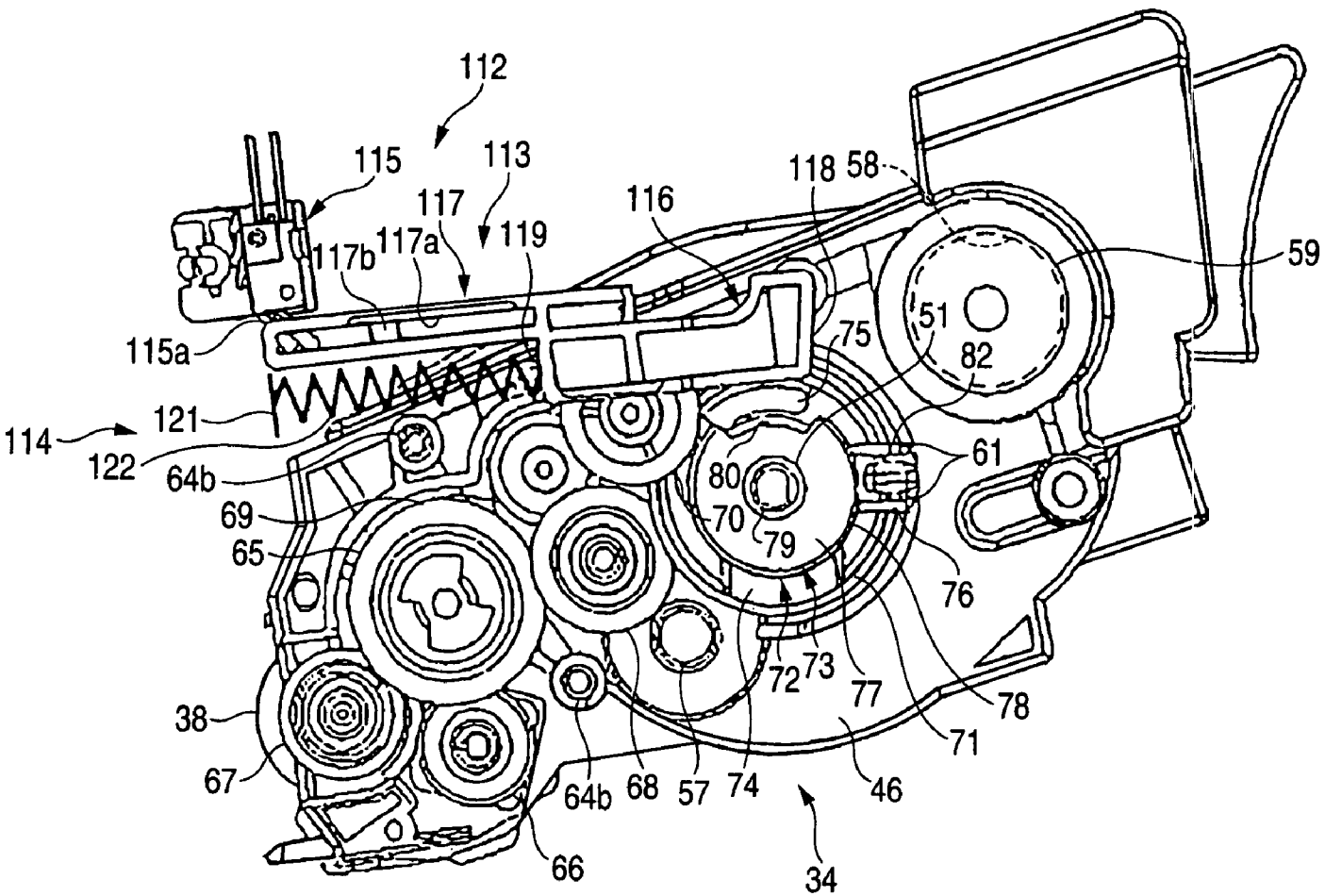
FIG. 9 is a side elevation showing the state, in which the cover member of the developer cartridge is removed.

FIG. 2 is a side elevation of the process unit; FIG. 3 is a side elevation of a developer cartridge; FIG. 4 is a side elevation of the developer cartridge having a cover member removed; and FIG. 5 is a top plan view of the developer cartridge. Moreover, FIGS. 6 and 7 are side elevations of the developer cartridge when a detection gear is in a power transmission position, and FIGS. 8 and 9 are side elevation of the developer cartridge when the detection gear is in an old product position.

The process unit 21 is disposed below the scanner unit 20 and is removably mounted in the body frame 2. Specifically, the body frame 2 is equipped with: a body housing unit 30 for housing the process unit 21; an opening 31 leading to the body housing unit 30 for mounting/demounting the process unit 21 on/from the body frame 2; and the front cover 32 for covering or uncovering the opening 31.

The body housing unit 30 is provided as such a space below the scanner unit 20 in the body frame 2 as can house the process unit 21.

The opening 31 is formed as a passage leading from the body housing unit 30 to the front cover 32. This front cover 32 is formed over the front face and upper face of the front side of the body frame 2.

This front cover 32 rocks between a closed position, in which it covers the opening 31, and an open position, in which it opens the opening 31. The process unit 21 is mounted in and demounted from the body housing unit 30 through the opening 31 as to set the front cover 32 in the open position. Here in this illustrative aspect, the structure of the laser printer 1, from which the process unit is removed, corresponds to the "image forming apparatus body" in the invention.

The process unit 21 is equipped, as shown in FIG. 2, with a drum cartridge 33 to be mounted in and demounted from the body frame 2, and a developer cartridge 34 or a developer to be removably mounted in the drum cartridge 33.

(A) Developer Cartridge

The developer cartridge 34 is equipped, as shown in FIG. 1, with: a casing 35, an agitator 36 acting as an agitating member disposed in the casing 35, a feed roller 37, a developer roller 38 and a layer thickness regulating blade 39.

The casing 35 is equipped with: a front wall 42; a bottom wall 43 curved backward from the lower end portion of the front wall 42; a lower wall 44 extending backward from the back end portion of the bottom wall 43; and a blade supporting wall 45 formed above the lower wall 44.

These front wall 42, bottom wall 43, lower wall 44 and blade supporting wall 45 and two side walls 46 and 47 disposed on the two sides in the widthwise direction (as will be termed into the direction perpendicular to the longitudinal direction, i.e., the widthwise direction of the casing 35) of those walls. Moreover, the casing 35, which is defined by the lower wall 44, the blade supporting wall 45 and the two side walls 46 and 47, has its back side opened to expose of a portion of the back side of the developing roller 38 to the outside.

In this casing 35, the space defined by the front wall 42, the bottom wall 43 and the two side walls 46 and 47, is formed as a toner reserving chamber 40 acting as the developer reserving chamber. On the back side, moreover, the space defined by the lower wall 44, the blade supporting wall 45 and the two side walls 46 and 47 is formed as a developer chamber 41. Moreover, the casing 35 is equipped with an upper cover 48 for covering the upper opening of the casing 35.

The toner reserving chamber 40 reserves the toner as the developing agent. The toner used is a polymerized toner, which is prepared by copolymerizing a polymerizable monomer represented by a positively chargeable non-magnetic single component of a styrene monomer such as styrene, an acrylic monomer such as acrylic acid, alkyl (C1 to C4) acrylate or alkyl (C1 to C4) methacrylate, by the well-known polymerization method such as the suspension polymerization.

In the toner reserving chamber 40, there is disposed the agitator 36. This agitator 36 is made of a resin material such as an ABS resin having a flexibility that a shaft 51, blade members 52 mounted on the shaft 51, a flexible film member 53 applied to the blade members 52, and wiper supporting members 54 mounted on the shaft 51 are integrally molded. Here, the agitator 36 is rotated clockwise, as viewed in FIG. 1, in the toner reserving chamber 40.

The shaft 51 is arranged substantially at the center of the toner reserving chamber 40 in the side elevation and along the width direction of the casing 35 and is spanned between the two side walls 46 and 47. This shaft 51 has a shape of a round bar of a diameter of 3 to 8 mm, and is made flexible and longer than the spacing between the two side walls 46 and 47. One end portion of the shaft 51 on the side of one side wall 46 extends through the side wall 46 to the outside of the toner reserving chamber 40 and is rotatably supported on the side wall 46. On the other hand, the other end portion of the shaft 51 on the side of the other side wall 47 is rotatably supported by the other side wall 47 in the toner reserving chamber 40.

The blade members 52 are extended, without any contact with the individual side walls 46 and 47, all over in the axial direction of the agitator 36 in the toner reserving chamber 40. On the other hand, the film member 53 is made of a resin film of polyethylene terephthalate or the like and is adhered all over in the longitudinal direction of the blade members 52. Here, the film member 53 is set such a length to contact with the bottom wall 43 as to agitate the toner.

On the other hand, the wiper supporting portions 54 are protruded at the two axial end portions of the shaft 51 in the direction opposite of the protruding direction of the blade members 52. In the individual wiper supporting members 54, there are screwed wiper members 55 for wiping out toner residue detecting windows 56, as will be described in the following. The individual wiper members 55 are arranged to make elastic contact with the individual side walls 46 and 47 as to wipe out the toner residue detecting windows 56.

On the other hand, the two side walls 46 and 47 in the toner reserving chamber 40 are provided with the toner residue detecting windows 56. These toner residue detecting windows 56 are disposed on the lower side of the back of the toner reserving chamber 40 as to confront the two side walls 46 and 47 individually. As shown in FIGS. 2 and 3 or the like, the toner residue detecting windows 56 are provided with cylindrical optically transparent windows 57 in the outer surfaces of the two side walls 46 and 47. Across the two toner residue detecting windows 56, moreover, there are oppositely arranged photoelectric type toner shortage detecting sensors 196 (as referred to FIG. 19). These sensors 196 output detection signals of the toner shortage when the toner residue in the toner reserving chamber 40 becomes a predetermined limitation amount (in which sufficient toner cannot be transferred to the sheets 3 thereby to cause a faint printing).

In one side wall 46 of the toner reserving chamber 40, on the other hand, there is disposed a toner charging port 58. This toner charging port 58 is formed into a circular shape extending through one side wall 46 in the thickness direction. The toner charging port 58 is cover with a cap 59 in the state where the toner is reserved in the toner reserving chamber 40.

The developer chamber 41 is equipped with the feed roller 37, the developing roller 38 and the layer thickness regulating blade 39, as shown in FIG. 1.

The feed roller 37 is disposed at the back of the toner reserving chamber 40 and along the widthwise direction of the casing 35, and is rotatably supported in the two side walls 46 and 47. This feed roller 37 is disposed to rotate in the opposite direction of the rotating direction of the agitator 36. The feed roller 37 is prepared by coating a metallic roller shape with conductive urethane sponge.

The developing roller 38 is disposed on the back of the feed roller 37 and along the widthwise direction of the casing 35, and is rotatably supported in the two side walls 46 and 47 as is partially exposed from the opening formed in the back of the casing 35. This developing roller 38 is made rotatable in the same direction as the rotating direction of the feed roller 37.

Here, the developing roller 38 is prepared by coating the surface of a metallic roller shaft 38*a* with conductive urethane rubber or silicone rubber containing a conductive elastic material such as fine carbon grains and by coating the surface of the elastic material with a coating layer of urethane rubber or silicone rubber containing fluorine. At the time of a printing operation, moreover, a developing bias from a bias application circuit 198 is applied to the roller shaft 38*a* of the developing roller 38. This structure will be described in detail.

Those feed roller 37 and developing roller 38 are arranged to confront each other and to contact each other while being compressed to some extent. The feed roller 37 and the developing roller 38 rotate in the opposite directions at their confronting contact portions.

The layer thickness regulating blade 39 is disposed above the feed roller 37 and is supported by the blade supporting wall 45 of the casing 35 between the position opposed to the feed roller 37 in the rotation direction of the developing roller 38 and the position opposed to the photosensitive drum 99.

The layer thickness regulating blade 39 is arranged to confront the developing roller 38 along the axial direction of the developing roller 38, and is equipped with a leaf spring member 61 and a pressure contact portion 62 mounted on the front end portion of the leaf spring member 61 and made of insulating silicone rubber to contact with the developing roller 38. In the state where the leaf spring member 61 is supported by the blade supporting wall 45, the layer thickness regulating blade 39 is pressed on the surface of the developing roller 38 at the pressure contact portion 62 by the elastic force of the leaf spring member 61.

On the other hand, the developer cartridge 34 is equipped with a gear mechanism 63 for driving the agitator 36, the feed roller 37 and the developing roller 38 rotationally, as shown in FIG. 4, and a cover member 64 covering the gear mechanism 63, as shown in FIG. 3.

As shown in FIG. 4, the gear mechanism 63 is disposed in the outer side of one side wall 46 of the developer cartridge 34, and is composed of an input gear 65, a feed roller drive gear 66, a developing roller drive gear 67, a first intermediate gear 68, a second intermediate gear 69, a third intermediate gear 70 as the drive gear, an agitator drive gear 71 and a detection gear 72.

The input gear 65 is rotatably interposed between the developing roller 38 and the agitator 36 on the outer side of one side wall 46. The drive power of a main motor 200 (as referred to FIG. 16) is inputted to the input gear 65.

The feed roller drive gear 66 is mounted below the input gear 65 on the end portion of the roller shaft of the feed roller 37 as to mesh with the input gear 65.

The developing roller drive gear 67 is mounted at the end portion of the roller shaft 38*a* of the developing roller 38 on the back side of the input gear 65 as to mesh with the input gear 65.

The first intermediate gear 68 is rotatably mounted at the front side of the input gear 65 on the outer side of one side wall 46 as to mesh with the input gear 65. Moreover, the first intermediate gear 68 is formed into a two-stage gear, in which outer teeth to mesh with the input gear 65 and inner teeth (although not shown) to mesh with the second intermediate gear 69, as next described, are integrated on a common axis.

The second intermediate gear 69 is rotatably mounted above the first intermediate gear 68 on the outer side of one side wall 46 as to mesh with the inner teeth of the first intermediate gear 68. The third intermediate gear 70 is rotatably mounted at the front side of the second intermediate gear 69 on the outer side of one side wall 46 as to mesh with the (later-described) inner teeth of the second intermediate gear 69. Moreover, the third intermediate gear 70 is formed into a two-stage gear, in which outer teeth to mesh with the detection gear 72 and the inner teeth (although not shown) of the second intermediate gear 69 are integrated on a common axis.

The agitator drive gear 71 is mounted at one end portion of the shaft 51 of the agitator 36, which is protruded through one side wall 46 to the outer side, as to mesh with the inner teeth of the third intermediate gear 70 obliquely below the front of the third intermediate gear 70.

The detection gear 72 is mounted on the end portion of the shaft 51 of the agitator 36 as to overlap the agitator drive gear 71 in the widthwise direction on the axially outer side of the agitator 36 with respect to the agitator drive gear 71. The detection gear 72 rotates integrally with the rotating shaft 51 of the agitator 36.

Moreover, the detection gear 72 is equipped with a detection gear body portion 73, a guide member 74, a chipped gear portion 75 as a chipped gear, and an abutment member 76 as a discrimination member. These members are molded integrally with one another.

The detection gear body portion 73 is prepared by integrally molding a side plate portion 77 having a generally circular shape in side elevation and a generally circular cylinder portion 78 curved from the circumferential end edge of the side plate portion 77 toward the agitator drive gear 71.

In the central portion of the side plate portion 77, there is formed a circular hole 79, which extends through the side plate portion 77 in the thickness direction. The end portion of the shaft 51 of the agitator 36 is inserted into that hole 79 so that the side plate portion 77 is fixed through the hole 79 at the end portion of the shaft 51. As a result, the detection gear 72 is rotated integrally with the rotating shaft 51 of the agitator 36. A later-described support pin 88 of the cover member 64 is also inserted into that hole 79.

As shown in FIG. 4, the detection gear 72 (i.e., the guide member 74) to rotate integrally with the shaft 51 of the agitator 36 is equipped on its surface with an indication rib 270 for indicating the rotational position of the agitator 36. On the other hand, one side wall 46 of the developer cartridge 34 is equipped with an indication rib 271 at the side position of the detection gear 72. If the agitator 36 is buried in the toner agent in the toner reserving chamber 40 at the shipping stage of the developer cartridge 34, for example, the toner agent sink during the transportation. Then, the resistance to the rotations of the agitator 36 is raised to an undesirably high level at the beginning of the drive of the laser printer 1.

As has been described hereinbefore, therefore, the indication ribs 270 and 271 are formed and adjusted, as shown in FIG. 4, at the manufacturing stage so that the agitator 36 can be positioned to float from the toner agent in the toner reserving chamber 40. Here, the agitator 36 at this position is positioned to avoid the toner charging port 58 of the developer cartridge 34. At the manufacturing stage, therefore, the toner can be charged without being obstructed by the agitator 36. In short, there is provided agitator's rotational position indicating means, which enables the agitator 36 to be located from the outside of the toner reserving chamber 40.

The cylinder portion 78 is cut out at its circumferential portion to form a notch 80. The guide member 74 is disposed in the cylinder portion 78 on the opposite side of the notch 80 with respect to the hole 79. This guide member 74 is formed into a generally arcuate shape having substantially the same width as the notched width of the notch 80 so that it bulges in the cylinder portion 78 radially outward of the side plate portion 77.

The chipped gear portion 75 is formed into an arcuate shape having its one end portion merging into the one end portion of the notch 80 of the cylindrical portion 78 and directed from its one end portion toward the other end portion along the circumferential direction of the cylinder portion 78. This chipped gear portion 75 is formed to have such a length as to mesh with the third intermediate gear 70 only when the detection gear 72 is positioned at the later-described power transmission position. Here, the other end portion of the chipped gear portion 75 is such a play end portion as does not merge into the other end portion of the notch 80 of the cylinder portion 78.

The abutment member 76 is interposed in the circumferential direction of the cylinder portion 78 between the guide member 74 and the chipped gear portion 75, and is equipped with a support portion 81 and an abutment portion 82 acting as a displacement member supported by the support member 81.

The support portion 81 is protruded radially outward of the cylinder portion 78. The abutment portion 82 is formed in a generally rectangular plat shape, one side end portion of which is formed to continue to the play end of the support portion 81 and the other side end portion of which is formed to extend from the one side end toward the axially outer side of the shaft 51 of the agitator 36.

The detection gear 72 is attached to one end side of the shaft 51 of the agitator 36 protruded from one side wall 46 of the developer cartridge 34 as is arranged at the position, in which the chipped gear portion 75 of the detection gear 72 does not mesh with the third intermediate gear 70, and at a new product position on the upstream side in the rotational direction of the shaft 51 with respect to the third intermediate gear 70.

As shown in FIG. 3, the cover member 64 is disposed on the outer side wall of one side wall 46 of the developer cartridge 34 as to cover the gear mechanism 63. The cover member 64 is integrally equipped with a back side cover portion 83 for covering the input gear 65, the feed roller drive gear 66, the developing roller drive gear 67, the first intermediate gear 68, the second intermediate gear 69 and the third intermediate gear 70, and a front side cover portion 84 for covering the agitator drive gear 71 and the detection gear 72.

The back side cover portion 83 is prepared by integrally molding a back side plate portion 85, which is arranged on the outer side of the input gear 65, the feed roller drive gear 66, the developing roller drive gear 67, the first intermediate gear 68, the second intermediate gear 69 and the third intermediate gear 70, and a back side leg portion 86 (as referred to FIG. 5), which is bent from the peripheral end edge of the back side plate portion 85 toward one side wall 46 of the developer cartridge 34. In the back side cover portion 83, moreover, there are formed axial holes 91, which correspond to the shafts of the input gear 65 and the developing roller drive gear 67 so that the shafts may be exposed to the outside.

In the front side cover portion 84, there are integrally molded a disc portion 87 of a generally disc shape in a side elevation, which is arranged on the outer side 72 of the agitator drive gear 71 and the detection gear 72, and a front side leg portion 89 (as referred to FIG. 5) which is bent from the circumferential end edge of the disc portion 87 toward one side wall 46 of the developer cartridge 34. In the disc portion 87, there is formed an arcuate hole portion 92, which has its one end portion 93 arranged in the back side upper portion and its other portion 94 arranged in the front side lower portion.

More specifically, the hole portion 92 is formed into such generally arcuate shape in a side elevation as to expose the abutment portion 82 in the disc portion 87 and to follow the moving locus of the same. The hole portion 92 is formed to have its one end portion 93 corresponding to the position of the abutment portion 82, when the detection gear 72 is at the new product position, and its other end portion 94 corresponding to the position of the abutment portion 82 when the chipped gear portion 75 of the detection gear 72 is at a later-described old product position. Moreover, this hole portion 92 is equipped with a guide wall 95 around the hole portion 92, a bulging portion 97 merging into the guide wall 95, and a resistance application portion 96.

The guide wall 95 covers the hole portion 92 in the disc portion 87 and guides the abutment portion 82 along the moving locus of the abutment portion 82. This guide wall 95 is formed (as referred to FIG. 5) from the side of one end portion 93 of the hole portion 92 to the bulging portion 97, as will be described in the following, on the side of the other end portion 94 as it is protruded in the same direction as the protruding direction of the abutment portion 82, so that the abutment portion 82 may be exposed a predetermined length (from the disc portion 87 to the play end portion of the abutment portion 82 exposed to the outside) from the disc portion 87 to the outer side. The guide wall 95 is equipped with the bulging portion 97 on the side of the other end portion 94 of the hole portion 92.

The bulging portion 97 is formed into a general U-shape in a side elevation on the guide wall 95 on the side of the other end portion 94 of the hole portion 92. As shown in FIG. 6, moreover, the bulging portion 97 is formed to have a length substantially equal to that of the abutment portion exposed by a predetermined length from the disc portion 87 to the outside.

As shown in FIG. 3, the resistance application portion 96 is formed at the upper side peripheral edge portion of the hole 92 between the vicinity of one end portion 93 and the vicinity of the other end portion 94 of the hole portion 92. This resistance application portion 96 regulates the opening width of the hole portion 92 so that it can apply a resistance to the abutment portion 82 at the moving time of the abutment portion 82.

On the other hand, the disc portion 87 is equipped at its center with such a support pin 88 in the inner side wall confronting one side wall 46 of the developer cartridge 34 as to support the detection gear 72. This support pin 88 is fitted in the hole 79 of the detection gear 72 as to support the detection gear 72 rotatably.

A front side leg portion 89 is bent (as referred to FIG. 5) from the end edge of the disc portion 87 toward one side wall 46 of the developer cartridge 34 as to cover the agitator drive gear 71 and the detection gear 72. This front side leg portion 89 guides the guide member 74 of the detection gear 72 and protects the chipped gear portion 75 of the detection gear 72, when the detection gear 72 is integrally rotated as the shaft 51 of the agitator 36 rotates.

The cover member 64 is drilled to form threaded holes **64*a* in the upper back end portion, the upper front end side and the lower central portion. In one side wall 46 of the developer cartridge 34, moreover, threaded holes 64*b* are formed to correspond to the individually threaded holes 64*a* of the cover member 64**.

The cover member 64 thus formed is mounted on the side of one side wall 46 of the developer cartridge 34 by fastening it on the side wall 46 through the individually threaded holes **64*a* and 64*b* such that the individual shafts of the input gear 65 and the developing roller drive gear 67 are fitted in the individual axial holes 91 of the cover member 64, such that the support pin 88 of the cover member 64 is fitted in the hole 79 formed in the side plate portion 77 of the detection gear body portion 73, and such that the abutment portion 82 of the detection gear 72 is exposed from the hole portion 92 of the cover member 64. In the state where the cover member 64 is thus mounted, the abutment portion 82 is arranged to protrude from one end portion 93 of the hole portion 92**.

(B) Drum Cartridge

As shown in FIG. 1, the drum cartridge 33 is equipped with: a drum frame 98 as a photosensitive frame; the photosensitive drum 99 disposed in the drum frame 98; a scorotron type charger 100; a transfer roller 101; and a cleaning unit 102.

As shown in FIG. 2, the drum frame 98 is formed at its back portion into a drum housing portion 103 for housing the photosensitive drum 99, the scorotron type charger 100, the transfer roller 101 and the cleaning unit 102. The drum frame 98 is opened upward at its front and formed as a processing housing portion 104 for housing the developer cartridge 34 removably. In one side wall 105 of the drum frame 98, moreover, there are formed an introduction portion 106 for introducing the individual shafts of the input gear 65 and the developing roller driving gear 67, and a reception portion 107 disposed on the front side of the introduction portion 106.

The introduction portion 106 is formed into such a notch of a sector shape in a side elevation as is extended in a curve shape toward the lower back side from the upper end of one side wall 105 of the drum frame 98. The reception portion 107 is formed as a notch recessed downward from the upper end in one side wall 105 of the drum frame 98, and is sized to match the hole portion 92 of the developer cartridge 34, when the developer cartridge 34 is mounted in the drum cartridge 33, and to receive the bulging portion 97 and the abutment portion 82.

As shown in FIG. 1, the photosensitive drum 99 is arranged at the back of the developing roller 38 as to confront the developing roller 38. The photosensitive drum 99 is disposed along the widthwise direction of the drum frame 98 and is rotatably supported on the two widthwise end portions of the drum frame 98. This photosensitive drum 99 is formed by forming a positively chargeable photosensitive layer of polycarbonate or the like on the surface of a cylindrical aluminum raw pipe, and this cylindrical raw pipe is electrically earthed to the ground.

The scorotron type charger 100 is arranged above the photosensitive drum 99 as to confront but not contact with the same at a predetermined spacing and to extend along the widthwise direction of the drum frame 98. This scorotron type charger 100 is positively charging one for generating a corona discharge from the charging wire of tungsten thereby to charge the surface of the photosensitive drum 99 homogeneously to a positive polarity.

The transfer roller 101 is disposed below the photosensitive drum 99 as to confront the same, and is disposed along the widthwise direction of the drum frame 98 that it is rotatably supported at the two widthwise end portions of the drum frame 98. This transfer roller 101 is formed by coating a metallic roller shaft with a conductive rubber material, and the roller shaft is connected with the not-shown power source. When the toner is transferred to the sheet 3, the transfer bias is applied to the roller shaft.

In the laser printer 1, the developer cartridge 34 is mounted at first in the drum cartridge 33. More specifically, the developer cartridge 34 is mounted downward in the process housing portion 104 of the drum frame 98 of the drum cartridge 33. Then, the individual shafts, as protruded from the individual holes 91 of the cover member 64, of the input gear 65 and the developing roller drive gear 67 are introduced from the upper side of the introduction portion 106 so that they are arranged at the deepest positions of the introduction portion 106. The bulging portion 97 formed at the other end portion 94 of the hole portion 92 of the cover member 64 is received by the reception portion 107 formed in the drum frame 98. Thus, the developer cartridge 34 is mounted in the drum cartridge 33 thereby to construct the process unit 21.

The process unit 21 is housed in the body housing unit 30 of the body frame 2 through the opening 31 which is formed by the front cover 32 set in the open position.

On the other hand, the body frame 2 is equipped with a new/old discrimination mechanism 112 for discriminating the new/old state of the developer cartridge 34 when the process unit 21 is housed in the body housing unit 30.

(C) New/Old Discrimination Mechanism

The new/old discrimination mechanism 112 is disposed on one side wall side of the body frame 2 in the body housing unit 30, and is equipped with an actuator 113 as a detection member, a spring member 114 and a new/old discrimination sensor 115, as shown in FIG. 6.

The actuator 113 is formed into a bar shape, and is equipped with a pressure portion 116 at its front end and a guide portion 117 on the back side of the pressure portion 116.

The pressure portion 116 is formed into a generally rectangular shape in a side elevation, and is equipped with an abutted face 118 at its front end and a pushed face 119 at its back end.

The guide portion 117 is formed into a thin bar shape extending backward from the upper side of the back end portion of the pressure portion 116. A guide groove 117*a* is longitudinally formed in the guide portion 117.

On the other hand, the body frame 2 has a guide projection 117*b* to be fitted in the guide groove 117*a*. The actuator 113 is attached to the body frame 2 as can longitudinally slide because the guide groove 117*a* is fitted in the guide projection 117*b*.

The spring member 114 is equipped with a fixed plate 121 fixed on the body frame 2 and a spring 122 acting as a bias member having its one end portion fixed on the fixed plate 121. The other end portion of the spring 122 is held in abutment against the pushed face 119 of the pressure portion 116. By the biasing force of the spring 122, the actuator 113 is biased to the front at all times so that it is held at a first position.

The new/old discrimination sensor 115 is equipped with a detection lever 115*a*, which is disposed above the back end of the guide portion 117 as to rock back and forth. This detection lever 115*a* is retained by the guide groove 117*a* of the guide portion 117 and is longitudinally moved as the actuator 113 longitudinally moves. This new/old discrimination sensor 115 detects the old product of the developer cartridge 34, when the detection lever 115*a* rocks forward, and the old product of the developer cartridge 34 when the same rocks backward.

When the process unit 21 is mounted in the body housing unit 30 of the body frame 2, the abutment portion 82 of the detection gear 72 is pushed by the abutted face 118 of the actuator 113. Then, the abutment portion 82 of the detection gear 72 is slightly moved from one end portion 93 of the hole portion 92 to the side of the other end portion 94 of the opposite direction (to the front side of the body frame 2) of the mounting direction of the developer cartridge 34, so that the chipped gear portion 75 of the detection gear 72 is moved from the new product position, in which it does not mesh with the third intermediate gear 70, to the power transmission position, in which it meshes with the third intermediate gear 70, as shown in FIG. 7.

At this time, moreover, the actuator 113 is moved backward and positioned at a second position by the biasing force of the spring 122 against the reaction of the abutment portion 82. Then, the detection lever 115*a* of the new/old discrimination sensor 115 is rocked backward according to the backward movement of the actuator 113 so that the new product of the developer cartridge 34 is detected.

When the process unit 21 is mounted in the body housing unit 30, the warming-up operation (as termed as "non-image forming operation") is started in the laser printer 1 thereby to execute the rattling operation, in which the agitator 36 is rotationally driven.

Simultaneously as the power is transmitted from the input gear 65 to the agitator drive gear 71 through the first intermediate gear 68, the second intermediate gear 69 and the third intermediate gear 70, the power is transmitted from the input gear 65 through the first intermediate gear 68, the second intermediate gear 69 and the third intermediate gear 70 to the detection gear 72 which meshes with the third intermediate gear 70 at the power transmission position. As the shaft 51 of the agitator 36 rotates, the detection gear 72 is integrally rotated so that it is again moved from the power transmission position to the old product position, in which it does not mesh with the third intermediate gear 70, as shown in FIG. 9.

At this time, moreover, the abutment portion 82 is moved along the hole portion 92, while receiving the resistance of the resistance application portion 96, from the position, in which it has slightly moved from one end portion 93 of the hole portion 92, as shown in FIG. 6, to the other end portion 94 of the hole position 92, as shown in FIG. 8. The abutment portion 82 moved to the other end portion 94 of the hole portion 92 is enclosed by the bulging portion 97 formed to have the same length as that of the abutment portion 82.

According to the movement of the abutment portion 82, the actuator 113 is moved again to the front side by the biasing force of the spring 122 so that it is positioned at the first position. Then, the detection lever 115*a* of the new/old discrimination sensor 115 is slid to the front side, as the actuator 113 moves to the front side, so that it detects the old product of the developer cartridge 34.

Since the agitator 36 is rotated only in one clockwise direction, the detection gear 72 rotated to the old product position does not rotate again to the new product position, that is, the detection gear 72 is irreversibly from the new product position to the old product position. The detection gear 72 is slid with respect to the shaft 51 while being positioned at the old product position as to allow the rotational drive of the shaft 51.

When the warming-up operation ends, the ordinary printing operation (as termed as the "image forming operation") is then executed so that the toner reserved in the toner reserving chamber 40 is scraped up by the film member 53 and conveyed to the developing chamber 41 as the agitator 36 rotates, as shown in FIG. 1.

The toner conveyed to the inside of the developing chamber 41 is fed to the developing roller 38 by the rotation of the feed roller 37. While the toner is being fed from the feed roller 37 to the developing roller 38, it is scrubbed off between the feed roller 37 and the developing roller 38 so that it is charged to a positive polarity.

The toner thus charged is carried on the surface of the developing roller 38 so that it advances into the clearance between the developing roller 38 and the pressure contact portion 62 of the layer thickness regulating blade 39 as the developing roller 38 rotates. The toner is further charged by the friction, when it passes through the clearance between the developing roller 38 and the pressure contact portion 62 so that it is regulated in its layer thickness and carried as a thin layer on the surface of the developing roller 38.

In the drum cartridge 33, on the other hand, the photosensitive drum 99 is homogeneously positively charged on its surface, as it rotates, by the scorotron type charger 100, and is exposed to the laser beam emitted on the basis of the print data from the scanner unit 20 so that an electrostatic latent image is formed.

Next, as the developing roller 38 rotates, the toner, which is carried on the surface of the developing roller 38 and charged to the positive polarity, is fed, when it confronts and contacts with the photosensitive drum 99, to the electrostatic latent image formed on the surface of the photosensitive drum 99, that is, to such an exposed portion of the surface of the photosensitive drum 99 homogeneously charged to the positive polarity as is exposed to the laser beam to have a lower potential, so that the toner is selectively carried to form a visible image. As the photosensitive drum 99 rotates, the sheet 3 transferred from the resist roller 11 passes through the clearance between the photosensitive drum 99 and the transfer roller 101 while contacting with the surface of the photosensitive drum 99, so that the toner carried on the surface of the photosensitive drum 99 is transferred to the sheet 3. The sheet 3 having the toner transferred thereto is conveyed toward the fixing unit 22.

On the other hand, the toner not transferred to the sheet 3 but left on the photosensitive drum 99 is recovered in the cleaning unit 102.

(d) Fixing Unit

The fixing unit 22 is disposed at the back of the process unit 21 and downstream of the transfer direction of the sheet 3, and is equipped with a heating roller 123, a pressure roller 124 and a conveyor roller 125. The heating roller 123 is provided with a halogen lamp as a heater in a metallic raw pipe. The pressure roller 124 is arranged below to confront the heating roller 123 as to push the heating roller 123 upward. The conveyor roller 125 is disposed downstream of the conveying direction of the sheet 3 with respect to the heating roller 123 and the pressure roller 124.

The toner transferred to the sheet 3 is melted, while passing through the clearance between the heating roller 123 and the pressure roller 124, by the heat so that it is fixed on the sheet 3. This sheet 3 is transferred, while being guided by a guide portion 126 vertically arranged at the back of the conveyor roller 125, toward a discharge roller 127 by the conveyor roller 125.

The sheet 3 thus conveyed by the conveyor roller 125 is then discharged by to a discharge tray 128 by the discharge roller 127.

2. Developer Contact/Non-Contact Mechanism

Figure 10:
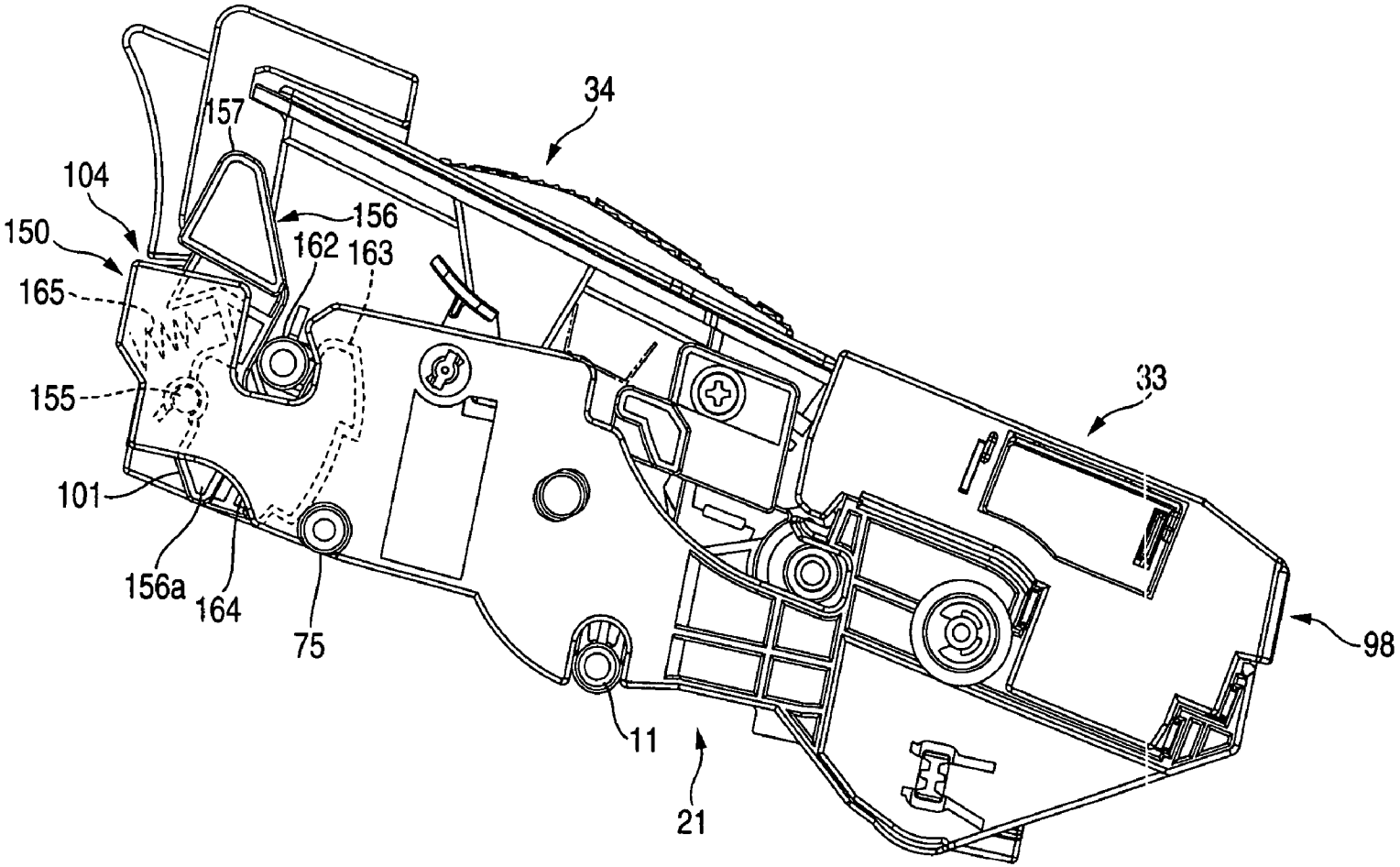
FIG. 10 is a side elevation showing the process unit of the laser printer.
Figure 11:
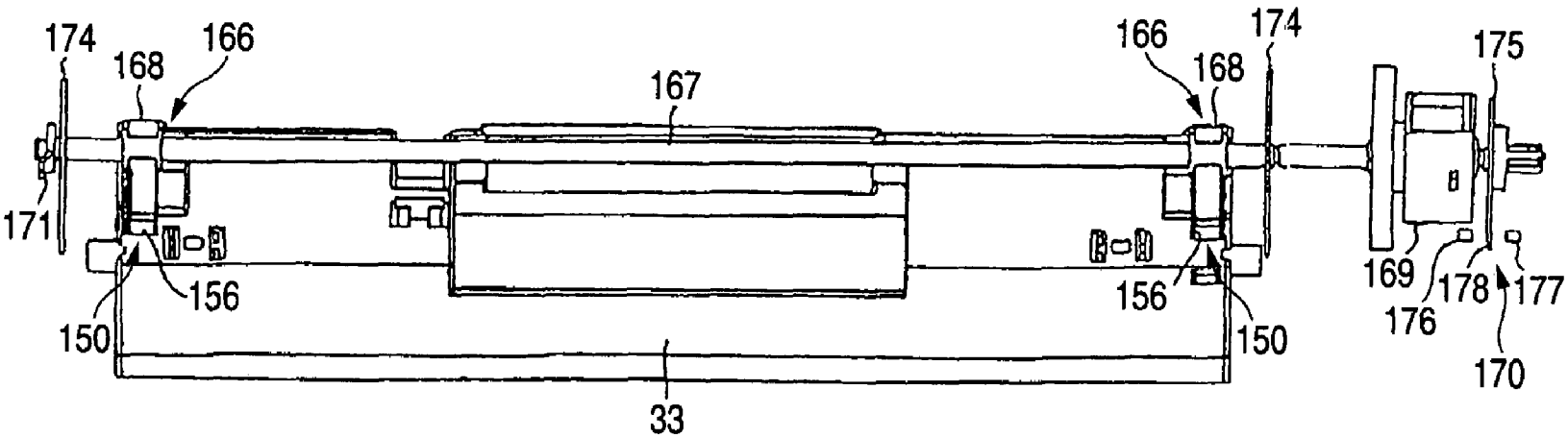
FIG. 11 is a front elevation showing an essential portion of the process unit and taken from the front side.
Figure 12:
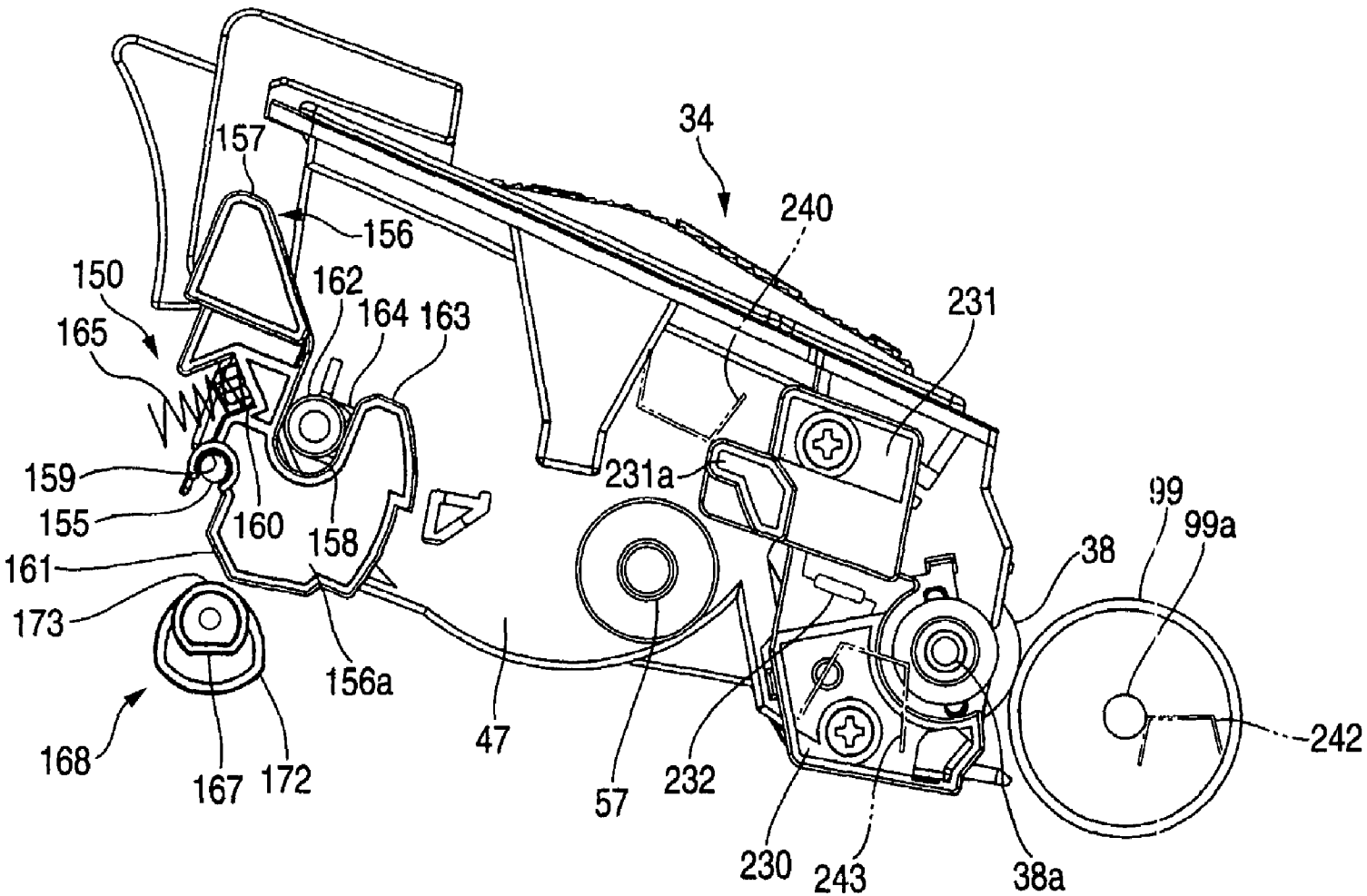
FIG. 12 is a side elevation showing the developer cartridge (in which a developing roller and a photosensitive drum contact with each other) of the process unit.
Figure 13:
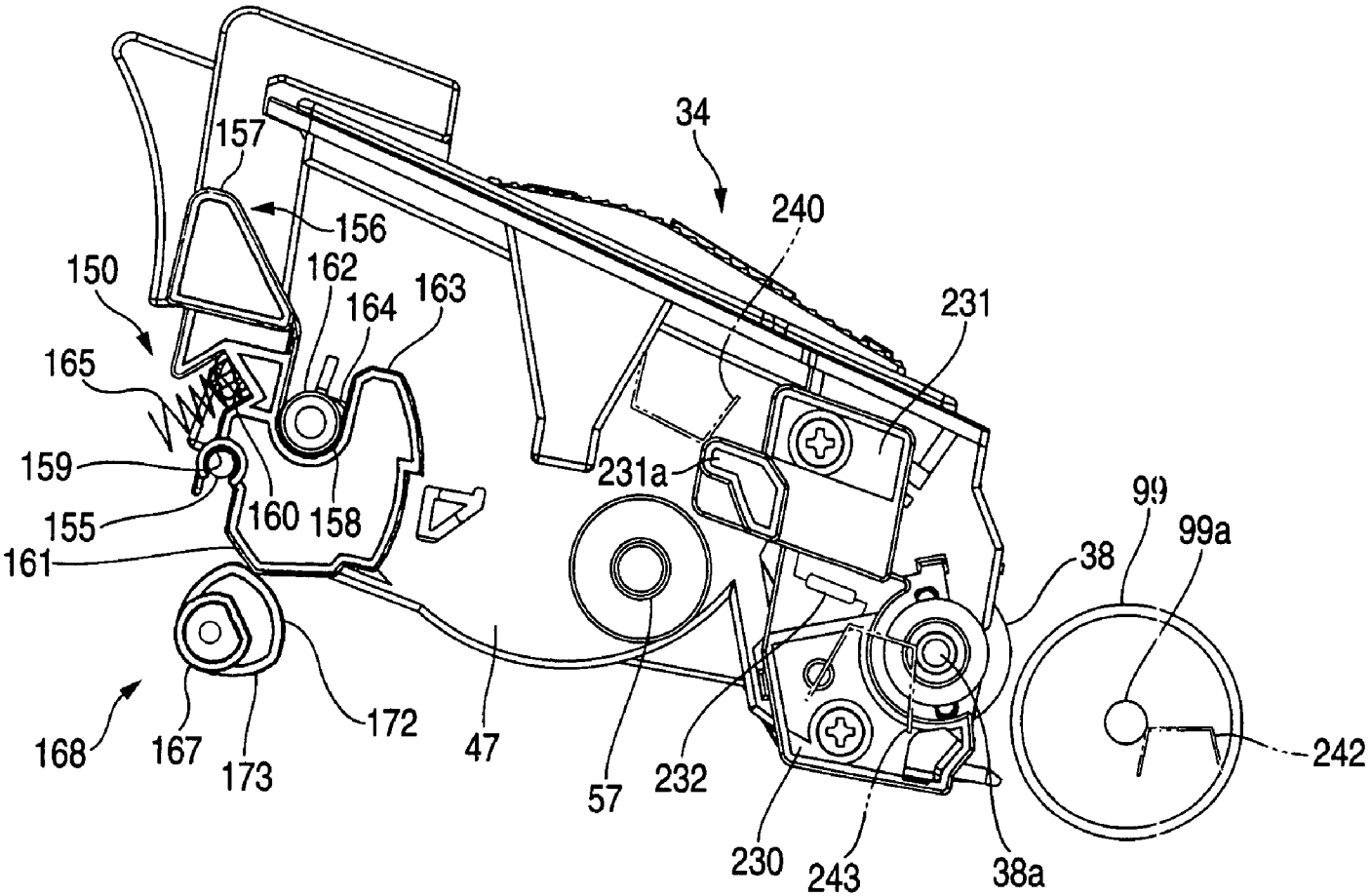
FIG. 13 is a side elevation showing the developer cartridge (in which the developing roller and the photosensitive drum are spaced from each other) of the process unit.

The laser printer 1 of this illustrative aspect is provided with a developer contact/non-contact mechanism (as termed as "displacement mechanism") for bringing the developer cartridge 34 (i.e., the developing roller 38) into or out of contact with the photosensitive drum 99. FIG. 10 is a side elevation, as viewed from the side of the other side wall 47, of the process unit 21, and FIG. 11 is a front elevation showing an essential portion of the process unit 21. FIGS. 12 and 13 are side elevations, as viewed from the side of the other side wall 47, of the developer cartridge 34.

This developer contact/non-contact mechanism is configured to include a developer side contact/non-contact mechanism unit 150 disposed in the developer cartridge 34, and a body side contact/non-contact mechanism unit 166 disposed in the body frame 2. As shown in FIG. 10, the developer side contact/non-contact mechanism unit 150 is provided with: support pins 155 as support members, levers 156 as engagement members; and springs 165 as biasing members.

As shown in FIG. 10 and FIG. 12, the support pins 155 are protruded from the two side walls of the front portion of the process housing portion 104 as to confront each other toward the inner sides of the widthwise direction.

The levers 156 are individually arranged on the axially inner side of the photosensitive drum 99, i.e., on the two side walls of the front portion of the process housing portion 104 as to correspond to the individual support pins 155. Each lever 156 is prepared by integrally forming: a lever body 156*a* made of a plate member; a knob portion 157 formed at the upper portion on the front side of the lever body 156*a*; a first reception portion 158 opened in a substantially U-shaped groove shape downward from the center of the upper face of the lever body 156*a*; a second reception portion 159 opened in a substantially U-shaped groove downward below the front end portion of the lever body 156*a*; a spring receiving portion 160 formed between the knob portion 157 and the second reception portion 159 at the front end portion of the lever body 156*a* and recessed obliquely upward and backward; and an abutment face 161 formed obliquely on the front side of the lower face of the lever body 156*a*.

In the opening portion of the first reception portion 158 of the lever 156, there is also formed a slope face 163 for guiding an engagement pin 162.

The levers 156 are rockably supported by the support pins 155 by fitting the second reception portion 159 opened downward, on the support pins 155 of the process housing portion 104. In this state, the levers 156 can rock between the contact position, in which the developing roller 38 and the photosensitive drum 99 make contact, and the spaced position, in which the developing roller 38 and the photosensitive drum 99 are spaced from each other, as will be described hereinafter. In this state, moreover, the lower end portion including the abutment faces 161 of the levers 156 communicates downward through a notch 164 of the process housing portion 104.

On the two widthwise sides of the front end portion of the process housing portion 104, moreover, each of the springs 165 has its one end portion retained on the front wall of the process housing portion 104 and its other end portion received by the spring receiving portion 160.

As a result, the levers 156 are biased at all times by the biasing force of the spring 165 that their upper sides are inclined backward whereas their front sides are inclined forward on the support pins 155. Accordingly, as described later, the levers 156 are biased at all time by the biasing force of the spring 165 that they position on the contact position.

As shown in FIG. 11, the body frame 2 is equipped with the body side contact/non-contact mechanism unit 166 for rocking each lever 156. This body side contact/non-contact mechanism unit 166 is equipped with: a drive shaft 167 as a connecting member; cams 168 as a pressure member and a moving member; a clutch 169; a sensor (as will be called the "position sensor") 170 for detecting the position of the developer cartridge 34 (i.e., the developing roller 38); and a release plate 171 as an abutment member.

As shown in FIG. 11 and FIG. 12, each drive shaft 167 is mounted in each cam 168 as to confront the lever 156 of the drum frame 98 mounted in the body frame 2. The cam 168 is made of a thick plate member eccentric to the drive shaft 167, and is equipped with a first cam face 172 for abutting against the abutment face 161 of the lever 156, as shown in FIG. 13, and a second cam face 173 for not-abutting against the abutment face 161 of the lever 156, as shown in FIG. 12.

Moreover, each cam 168 is formed on the drive shaft 167 as to take the same phase with respect to the lever 156, namely, that the first cam face 172 and the second cam face 173 may take the same position, as viewed in a side elevation. As a result, each cam 168 is rotated by the rotation of the drive shaft 167 and is alternately positioned to come into and out of engagement with the abutment face 161 of the lever 156 that the first cam face 172 and the second cam face 173 may alternately confront the abutment face 161 of the lever 156 with the same timing and may be positioned between the pressure position (i.e., a first position), in which the first cam face 172 of the cam 168 abuts against the abutment face 161 of the lever 156, and the non-pressure position (i.e., a second position), in which the second cam face 173 of the cam 168 does neither confront nor abut against the abutment face 161 of the lever 156.

As shown in FIG. 11, the clutch 169 is disposed on one axial side of the drive shaft 167 and on the outer side of a shaft supporting portion 174 in the other direction. The motive power from a spacing motor 202 (as referred to FIG. 16) is inputted to the clutch 169 for transmitting or blocking the motive power to or from the drive shaft 167. This clutch 169 is made of the well-known spring clutch, and transmits the power from the spacing motor 202 through the not-shown gear train to the drive shaft 167. In the off state, on the other hand, the clutch 169 blocks the transmission of the power from the spacing motor 202 to the drive shaft 167.

More specifically, the clutch 169 is turned ON at the time of the printing operation to transmit the power from the spacing motor 202 to the drive shaft 167 thereby to rotate the cam 168. On the other hand, when it is necessary, at the time of ending the printing operation or at the occurrence of an error, to position the front cover 32 at the open position thereby to extract the process unit 21, the clutch 169 is turned OFF to block the transmission of the power from the spacing motor 202 to the drive shaft 167 thereby to establish the free state of the cam 168.

The position sensor 170 is equipped with a sensor disc 175 as a shielding plate, a light emitting portion 176 and a light receiving portion 177.

The sensor disc 175 is disposed on one axial side end portion of the drive shaft 167 axially outer than the clutch 169. The sensor disc 175 is formed into a disc shape, as shown in FIG. 14, and is molded integrally with a generally sector-shaped shielding portion 178 bulged radially outward.

The light emitting portion 176 and the light receiving portion 177 are configured as a light sensor and are arranged to confront each other at positions across the shielding portion 178 of the sensor disc 175. As a result, the shielding portion 178 of the sensor disc 175 passes through the clearance between the light emitting portion 176 and the light receiving portion 177 as the drive shaft 167 rotates.

Figure 14A:
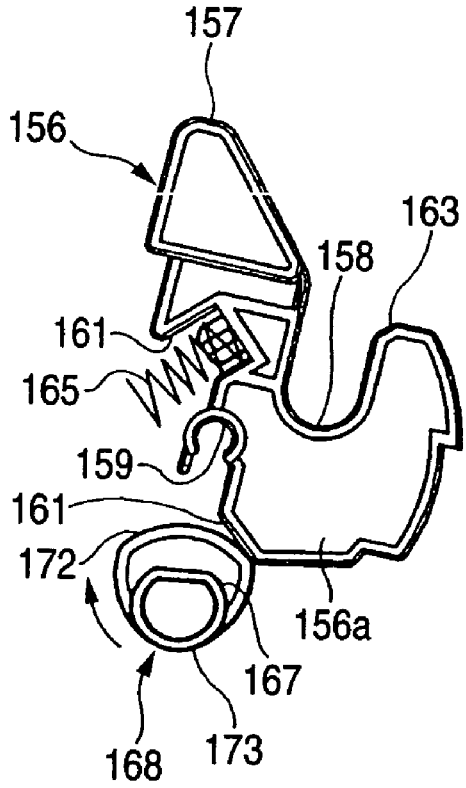
Figure 14B:
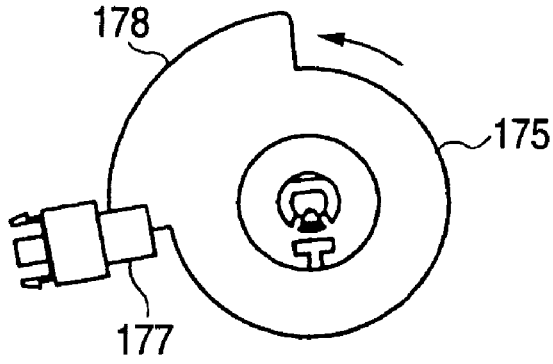
Figure 15A:
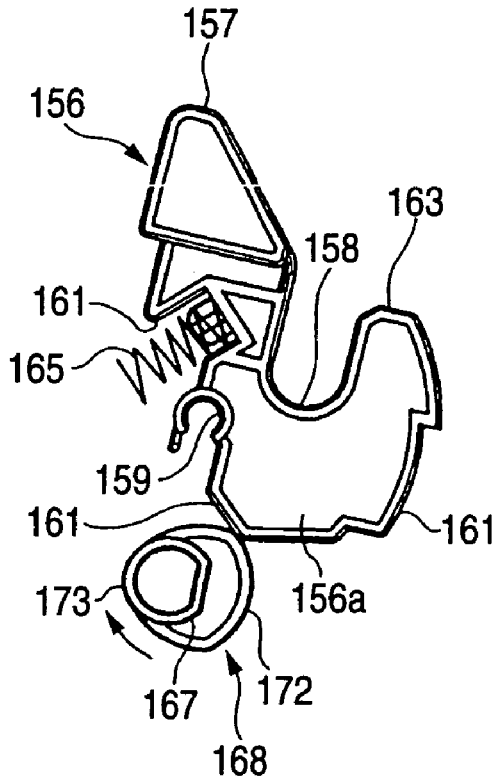
Figure 15B:
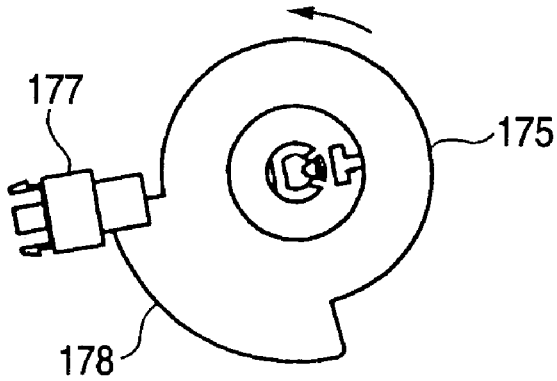

In this position sensor 170, synchronously as the first cam face 172 of the cam 168 is caused to start its abutment against the abutment face 161 of the lever 156 by the rotational drive of the drive shaft 167, as shown in FIG. 14A, the shielding portion 178 begins to advance into the clearance between the light emitting portion 176 and the light receiving portion 177 thereby to shield the light from the light emitting portion 176 to the light receiving portion 177, as shown in FIG. 14B. Simultaneously as the first cam face 172 of the cam 168 is rotationally driven by the drive shaft 167 to end the abutment against the abutment face 161 of the lever 156, as shown in FIG. 15A, the shielding portion 178 ends the advance into the clearance between the light emitting portion 176 and the light receiving portion 177 thereby to transmit the light from the light emitting portion 176 to the light receiving portion 177, as shown in FIG. 15B.

In short, in the position sensor 170, the light from the light emitting portion 176 to the light receiving portion 177 is shielded, while the cam 168 is pushing the lever 156, but is passed while the cam 168 is not pushing the lever 156. It is, therefore detected whether the cam 168 is at the pressure position, in which it is pushing the lever 156, or at the non-pressure position, in which it is not pushing the lever 156.

By detecting the pressure position or the non-pressure position of the lever 156 by the position sensor 170, therefore, it is possible to detect the contact or non-contact state between the developing roller 38 and the photosensitive drum 99.

Moreover, this position sensor 170 detects the pressure position or the non-pressure position of the cam 168 independence upon whether the light emitted from the light emitting portion 176 and received in the light receiving portion 177 is shielded by the shielding portion 178, so that a reliable detection can be made.

As shown in FIG. 10, the developer cartridge 34 is housed in the processing housing portion 104 of the drum cartridge 33 that the engagement pin 162 are received downward in the first reception portion 158, as opened upward, of each lever 156.

At this time, in the state where the developer cartridge 34 is housed in the process housing unit 104 of the drum cartridge 33, the levers 156 are pushed backward at their upper sides on the support pins 155 by the biasing forces of the springs 165 and are positioned in the contact positions so that the engagement pins 162 engaging with the levers 156 are arranged on the back side. As a result, as shown in FIG. 12, the developer cartridge 34 is arranged on the back of the drum cartridge 33 to bring the developing roller 38 and the photosensitive drum 99 into contact.

Thus in the developer cartridge 34 mounted in the body housing unit 30, that is, in the process unit 21, at the developing time, i.e., at the time of the printing operation in the laser printer 1, the second cam faces 173 of the cams 168 confront the abutment faces 161 of the levers 156 so that they are positioned in the non-pressure positions having no mutual abutment, as shown in FIG. 12. When the cams 168 are positioned at the non-pressure positions, the levers 156 are positioned at the contact positions by the biasing forces of the springs 165, as described above, so that the developing roller 38 and the photosensitive drum 99 come into contact with each other.

When it is necessary for the warming-up operation or the like that the developing roller 38 and the photosensitive drum 99 are spaced from each other, on the other hand, the laser printer 1 inputs the motive power from the spacing motor 202 to the drive shaft 167 thereby to rotate the drive shaft 167 so that the first cam faces 172 of the cams 168 are positioned at the pressure positions, in which they confront and abut against the abutment faces 161 of the levers 156. As shown in FIG. 13, the first cam faces 172 of the cams 168 push the abutment faces 161 of the levers 156 so that the levers 156 rock on the support pins 155 forward on their upper sides and backward on their lower faces against the biasing forces of the springs 165 and are positioned at the spaced positions. When the levers 156 are positioned at the spaced positions, the engagement pins 162 engaging with the first receptions 158 of the levers 156 are moved forward according to the rocking motions of the levers 156 so that the developer cartridge 34 is moved forward with respect to the drum cartridge 33. As a result, the developing roller 38 is spaced from the photosensitive drum 99.

3. Structure for Applying Developing Bias or the Like to Developing Roller

Figure 16:
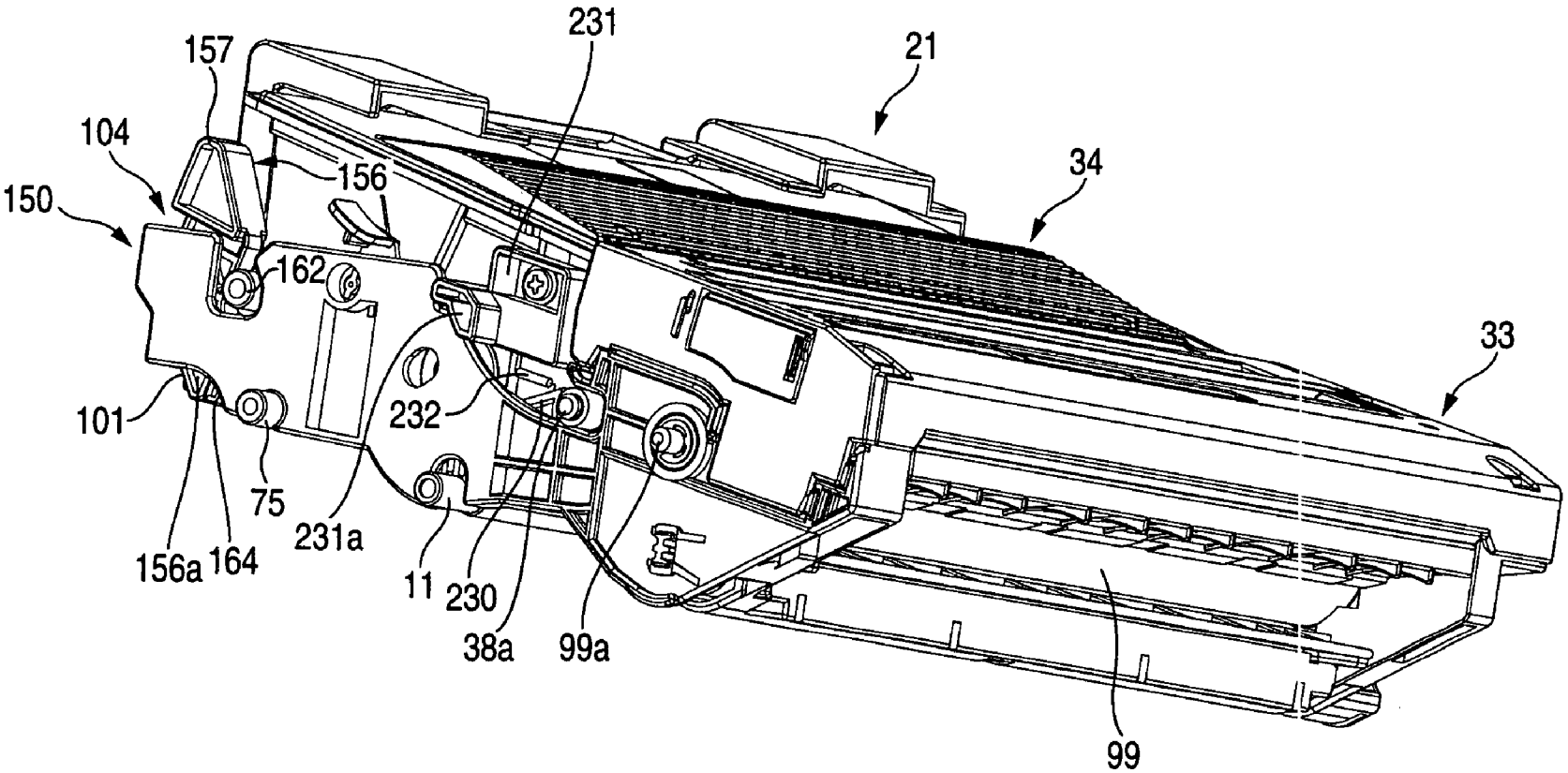
FIG. 16 is a perspective view showing the process unit from the front side.
Figure 17:
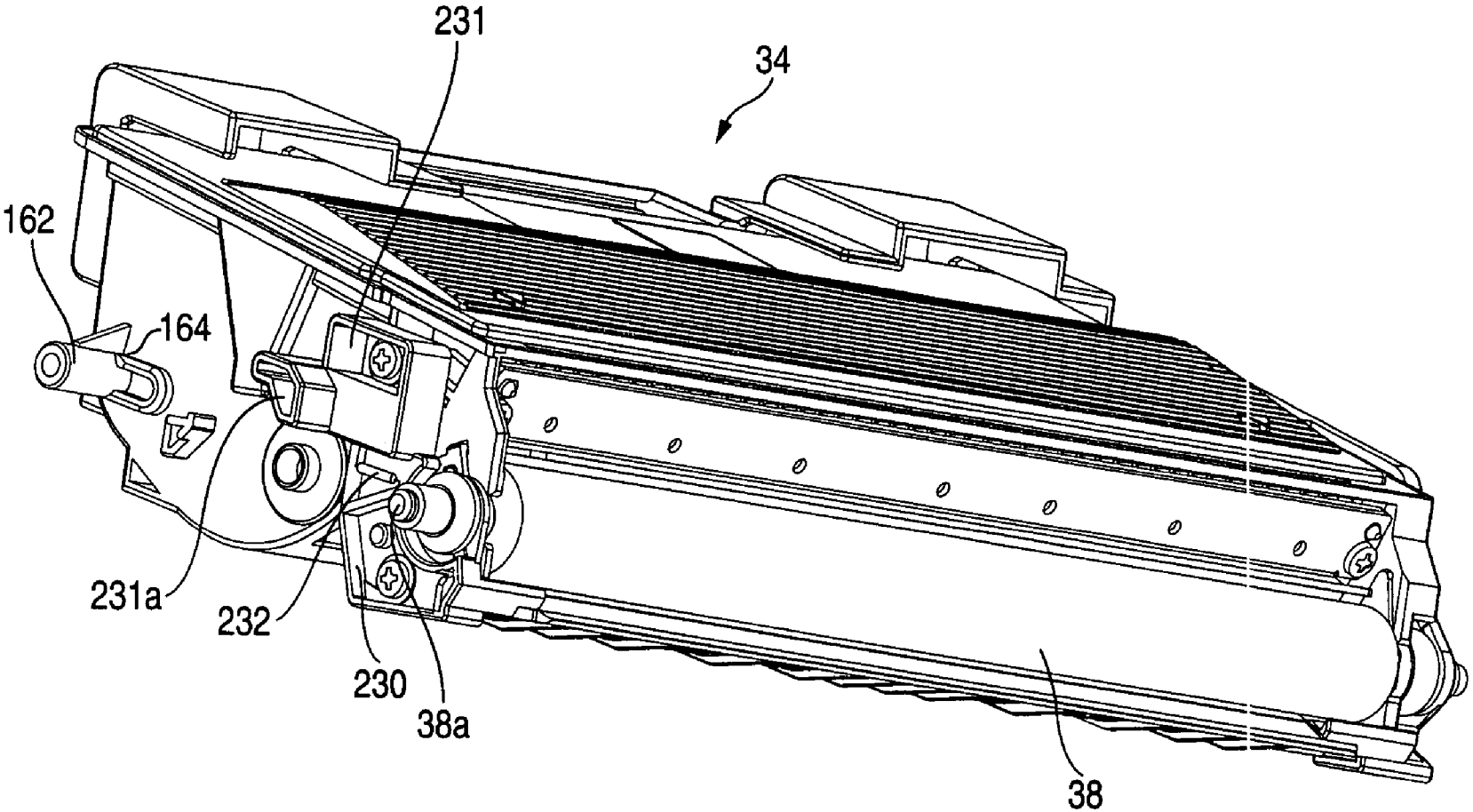
FIG. 17 is a perspective view showing the developer cartridge from the front side.

FIG. 16 is a perspective view, as taken from the front side, of the process unit, and FIG. 17 is a perspective view, as taken from the front side, of the developer cartridge. As shown in FIGS. 10, 16 and 17, the end potions of the roller shaft 38*a* of the developing roller 38 are rotatably borne by bearing members 230 made of a conductive material, and a developing side electrode 231 is disposed at a position spaced upward from the bearing members 230. The developing side electrode 231 is fastened by a screw on the other side wall 47 and equipped at its back end with a contact portion 231*a*, which is protruded to contact with a developing side power supply member 240 disposed on the body frame 2. In this illustrative aspect, the bearing members 230 and the developing side electrode 231 are electrically connected through a fuse element 232.

Figure 18:
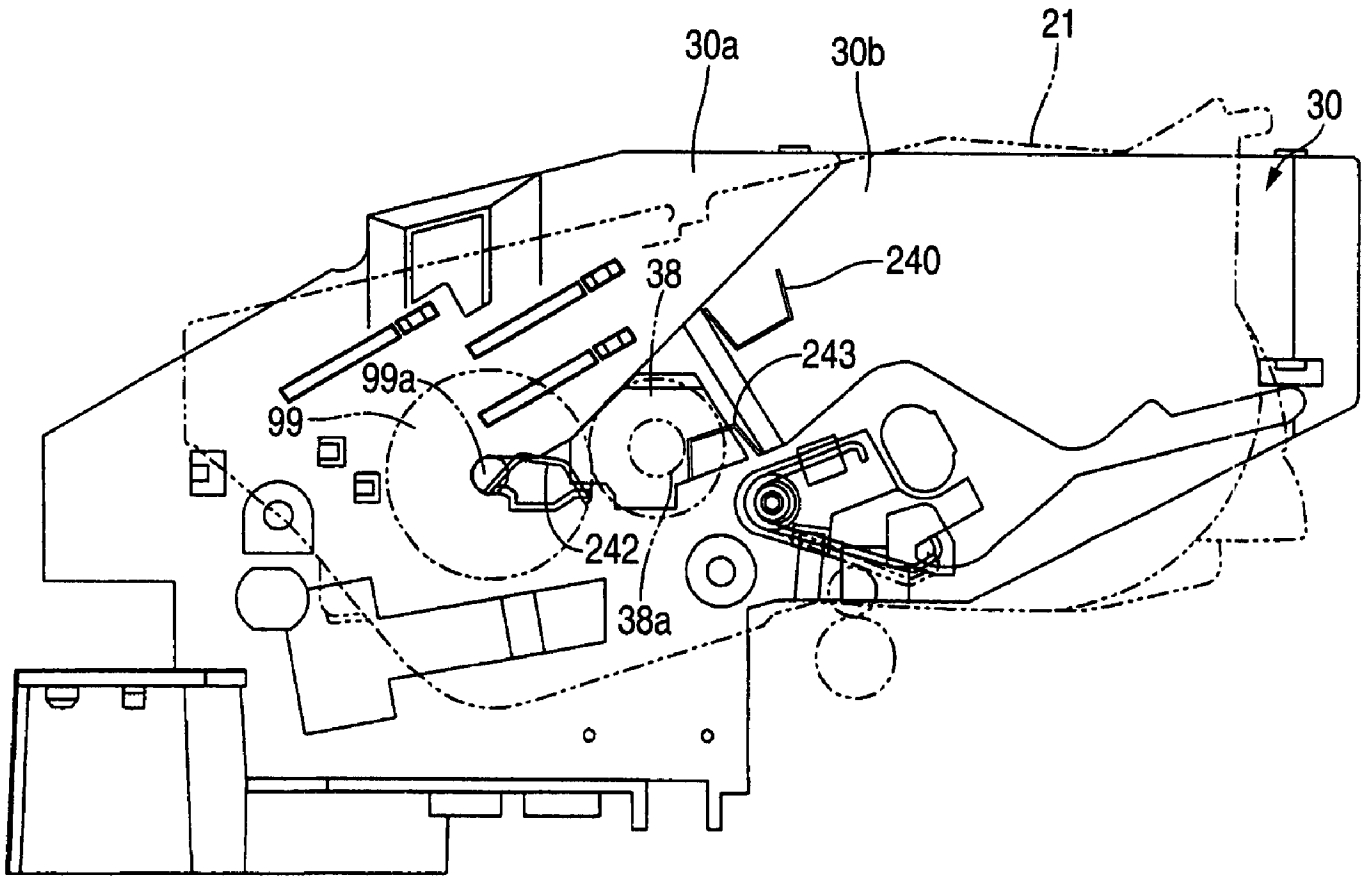
FIG. 18 is a schematic view showing the inner wall face of a body housing unit.

FIG. 18 is a schematic diagram showing a portion of such an inner wall face 30*a* of the body housing unit 30 as to confront the other side wall 47 of the process unit 21. In the inner wall face 30*a*, as shown, there is recessed a guide groove 30*b*, which is widely opened toward the opening 31. At the most trailing portion of the guide groove 30*b*, there is disposed such a drum side earth electrode 242 made of a wire spring as contacts with the end portion of the roller shaft 99*a* of the photosensitive drum 99 when the process unit 21 is completely mounted.

In the central upper portion of the guide groove 30*b*, on the other hand, there is disposed the developing side power supply member 240 of a wire spring, which makes contacts with the contact portion 231*a* of the developing side electrode 231 when the process unit 21 is completely mounted. Between the drum side earth electrode 242 and the developing side power supply member 240, moreover, there is interposed a developing side earth electrode 243 of a wire spring, which can be brought into contact/non-contact with the end portion of the roller shaft 38*a* of the developing roller 38 when the process unit 21 is completely mounted.

When the developer cartridge 34 is in the contact position, as shown in FIG. 12, the developing side electrode 231 makes contact with the developing side power supply member 240, but the developing side earth electrode 243 is spaced from the roller shaft 38*a* of the developing roller 38. When the developer cartridge 34 is at the spaced position, as shown in FIG. 13, the developing side electrode 231 and the developing side power supply member 240 keep their contact so that the roller shaft 38*a* of the developing roller 38 and the developing side earth electrode 243 make contact.

4. Control Unit of Laser Printer

Figure 19:
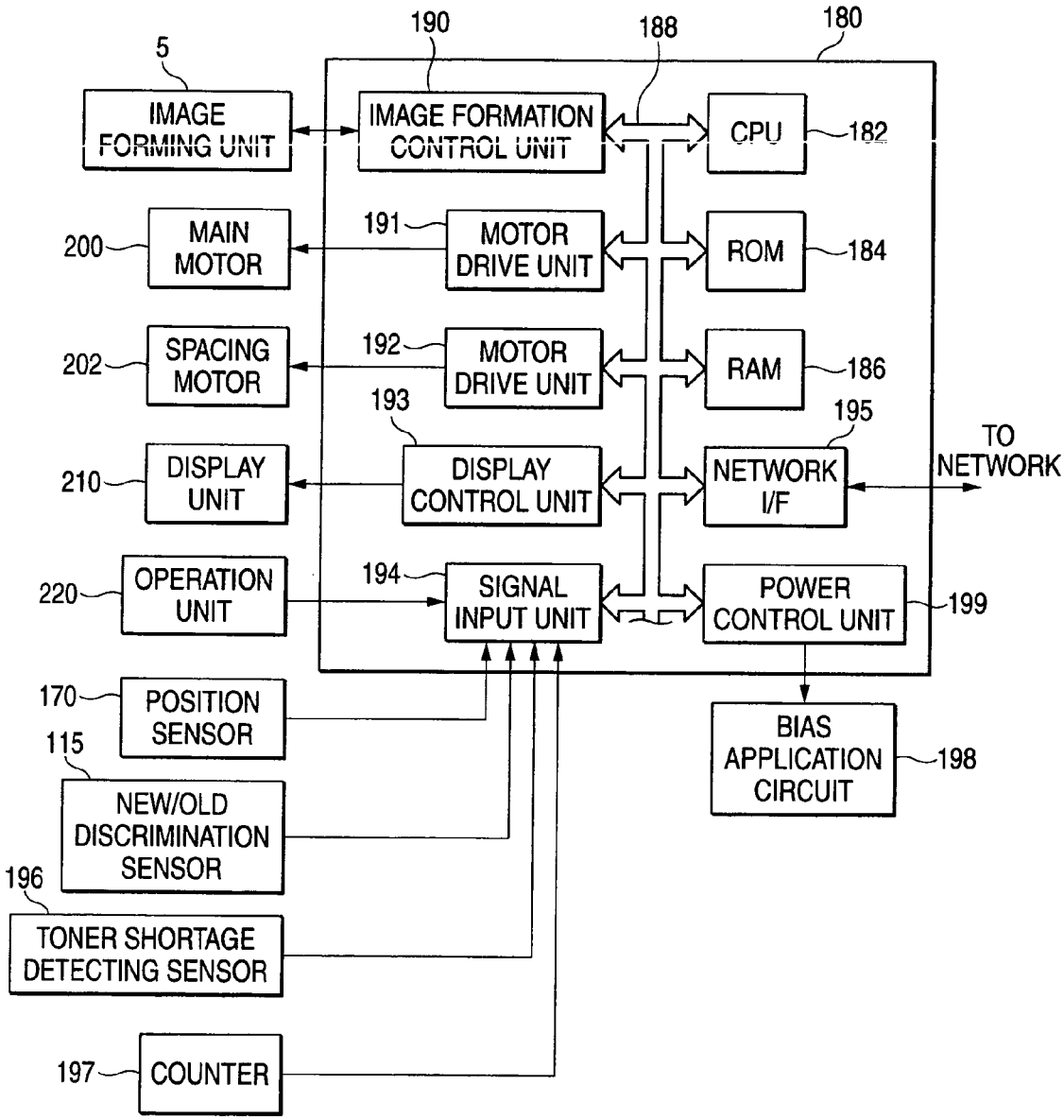
FIG. 19 is a block diagram showing a configuration of a control device packaged in the laser printer.

Next, FIG. 19 is a block diagram showing a configuration of a control device 180 packaged the laser printer 1 so as to control the individual portions thus far described.

The control device 180 controls the image forming unit 5 composed of the scanner unit 20, the process unit 21 and the fixing unit 22, the main motor 200 acting as the power source for the sheet conveying line of the laser printer 1, the spacing motor 202 acting as the power source for the developer contact/non-contact mechanism, and so on in accordance with either the commands from the user, as inputted through a control unit 220, or the commands from various information processing devices (e.g., a personal computer), as inputted through the network. The control device 180 is configured of the well-known microcomputer including a CPU 182, a ROM 184, a RAM 186, and a bus line 188 connecting those portions.

Moreover, the control device 180 is provided with: an image forming control unit 190 for controlling the image forming unit 5 in accordance with the commands from the CPU 182; motor drive units 191, 192 for driving the main motor 200 and the spacing motor 202 individually in accordance with the commands from the CPU 182; a display control unit 193 for displaying the operation conditions or the like of the printer 1 in a display unit 210 made of a liquid crystal display device or the like, in accordance with the commands from the CPU 182; a signal input unit 194 for fetching the command signals inputted from the user through the control unit 220 and the detection signals from the position sensor 170, the new/old discrimination sensor 115 and the toner shortage detecting sensors 196, into the control device 180; and a network interface (i.e., a network I/F) 195 for data communications with an external information processing device (e.g., a personal computer) through the network. These individual units are connected with the CPU 182, the ROM 184 and the RAM 186 through the bus line 188.

Moreover, a power control unit 199 for controlling the bias application circuit 198 to apply biases to the individual portions, e.g., to apply a developing bias voltage to the developing side power supply member 240 is connected through the bus line 188 with the CPU 182 or the like. At the time of the printing operation of the laser printer 1 (when the developer cartridge 34 is in the contact position), that power control unit 199 controls the voltage of the bias application circuit 198 thereby to apply the developing bias to the developing roller 38 through the developing side power supply member 240 and the bearing members 230.

At the time of the non-printing operation (when the developer cartridge 34 is at the spaced position) as when the power control unit 199 and the laser printer 1 are being warmed-up, on the other hand, it may be determined that the lifetime of the developer cartridge 34 has elapsed. Then, the current of the bias application circuit 198 is controlled to feed a fusing current capable of fusing the fuse element 232 through the developing side power supply member 240 and the bearing members 230. This fusing current flows to the ground through the developing side earth electrode 243 contacting with the developing roller 38.

A detection signal from a counter 197 for counting the number of rotations of the developing roller 38 is also inputted to the signal input unit 194.

The CPU 182 drives and controls, when the CPU 182 receives a print demand from the external information processing device through the network, the image forming control unit 190 and the main motor 200 in accordance with the print data sent through the network, so that an image is formed on the sheet 3 being conveyed, on the basis of the print data.

In order to ensure the image formation on the sheet 3, moreover, the CPU 182 determines whether or not a sheet clogging (or a sheet jamming) or a toner shortage has occurred during the image formation on the conveyor passage of the sheet 3. When the CPU 182 detects the sheet jamming or the toner shortage by the toner shortage detecting sensors 196, the CPU 182 determines that an image formation inhibiting error has occurred, and stops the operations of the image forming unit 5. The CPU 182 executes the operation to inhibit the printing operation.

In case the developer cartridge 34 (i.e., the developing roller 38) is spaced when the image is formed on the sheet 3, on the other hand, the CPU 182 drives the spacing motor 202 acting as the power source for the developer spacing mechanism thereby to bring the developer cartridge 34 (i.e., the developing roller 38) into contact with the photosensitive drum 99. At the warming-up time when it is necessary to space the developing roller 38 and the photosensitive drum 99, the CPU 182 drives the spacing motor 202 thereby to execute the contact/non-contact control of the developer cartridge 34, in which the developer cartridge 34 (i.e., the developing roller 38) is spaced from the photosensitive drum 99.

When the control (i.e., the image forming control) for forming the image on the sheet 3 is not made, the CPU 182 rotates the spacing motor 202 one turn or more of the cam 168, and determines whether or not the spacing from the photosensitive drum 99 of the developer cartridge 34 has been detected during the rotation by the position sensor 170, thereby to decide whether or not the spacing error has occurred. In case the spacing of the developer cartridge 34 from the photosensitive drum 99 cannot be detected due to the breakage of the cam 168 or the trouble of the position sensor 170 in the developer contact/non-contact mechanism, the spacing error, in which the developer cartridge 34 always contacts with the photosensitive drum 99, is thought to have occurred. When the spacing error is detected by that processing, too, the CPU 182 inhibits, assuming that the image formation inhibiting error has occurred, the printing operation by the image forming unit 5. If the user inputs an image formation continuing command in this state through the control unit 220, the CPU 182 permits the printing operation by the image forming unit 5.

(1) The Spacing Error Detecting Routine is Described in the Following with Reference to a Flow Chart Shown in FIG. 20.

Figure 20:
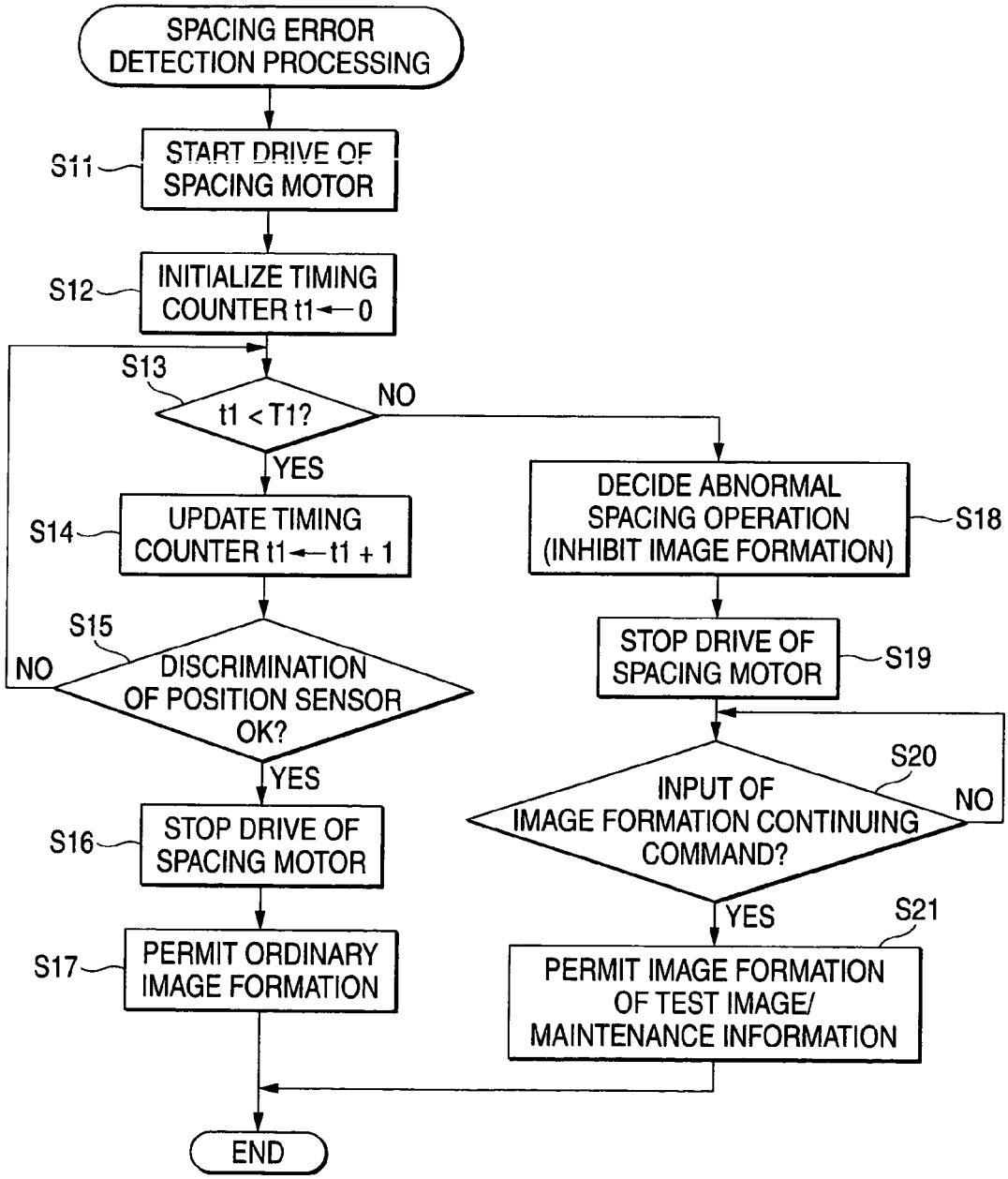
FIG. 20 is a flow chart showing a spacing error detecting operation.

In the spacing error detecting routine, as shown in FIG. 20, the drive of the spacing motor 202 is started at first at S11 (S designates a step). At subsequent S12, a drive time counting counter t1 of the spacing motor 202 is initialized to a value 0.

At subsequent S13, it is determined whether or not the value (i.e., the drive time period of the spacing motor 202) of the counter t1 is smaller than a set value T1 indicating the time period required for making one turn of the cam 168 of the developer contact/non-contact mechanism. In the case of t1<T1, that is, in case the drive time period of the spacing motor 202 is shorter than the set time period determined by the set value T1, the routine shifts to S14, at which the value of the counter t1 is incremented to update the drive time period of the spacing motor 202, and the routine shifts to S15.

At S15, it is determined whether or not the detection result of the contact/non-contact has been reversed. In case the detection result by the position sensor 170 is reversed, it is determined that the contact/non-contact of the developer cartridge 34 with the photosensitive drum 99 is normal, and the routine shifts to S16. At S16, the drive of the spacing motor 202 is stopped. At subsequent S17, the ordinary printing operation is permitted. After this, the spacing error detecting routine is ended.

In case, on the other hand, it is determined at S15 that the detection result of the position sensor 170 has not been reversed, the routine again shifts to S13, at which it is determined whether or not the value of the counter t1 is smaller than the set value T1. In case it is determined at S13 that the value of the counter t1 is at the set value T1 or more and that the drive time period of the spacing motor 202 has reached the set value determined by the set value T1, the routine shifts to S18, at which it is determined that the spacing operation of the developer cartridge 34 from the photosensitive drum 99 by the developer spacing mechanism is abnormal, and the inhibition of the printing operation by the image forming unit 5 is executed.

After the printing operation was thus inhibited at S18, the drive of the spacing motor 202 is stopped at S19. After this, at S20, it is determined by operating such ones of a plurality of keys disposed in the control unit 220 in a predetermined order as to input a predetermined image formation continuing command whether or not the image formation continuing command has been inputted.

When it is determined at S20 that the image formation continuing command has been inputted, the routine shifts to S21 to permit either the image formation based on the print data for the test image formation stored beforehand in the ROM 184, or the operation as the image formation permitting means for permitting the image formation of the maintenance information designating the operation history or the prevailing state of the laser printer 1 stored in the RAM 186, thereby to end the spacing error detecting operation.

When the process unit 21 is mounted in the body housing unit 30, the CPU 182 then starts the aforementioned warming-up operation thereby to detect whether the developer cartridge 34 is new or old. When the new/old discrimination mechanism 112 used for that detection fails so that the new/old state of the developer cartridge 34 cannot be discriminated, the quantity of toner to be applied to the photosensitive drum 99 at the image forming time cannot be controlled to the optimum so that a clean image may be unable to be formed on the sheet 3.

In the illustrative aspect, therefore, when the new/old discrimination of the developer cartridge 34 is made by the CPU 182 using the new/old discrimination mechanism 112, the failure of the new/old discrimination mechanism 112 is determined. In this case, the CPU 182 inhibits the printing operation by the image forming unit 5, assuming that the image formation inhibiting error has occurred.

In case the new/old discrimination mechanism 112 fails, as in case the spacing error of the developer cartridge 34 is caused by the failure of the developer contact/non-contact mechanism, the image formation by the image forming unit 5 can be executed. When the user inputs the image formation continuing command through the control unit 220 while the CPU 182 is inhibiting the image formation as a result the trouble of the new/old discrimination mechanism 112, the CPU 182 permits the printing operation by the image forming unit 5.

(2) New/Old Discriminating Operation

The new/old discriminating operation of the developer cartridge 34 to be thus executed by the CPU 182 after the process unit 21 was mounted in the body housing unit 30 is described in the following with reference to the flow chart shown in FIG. 21.

Here, the trouble to be considered in the new/old discrimination mechanism 112 may be exemplified by the trouble of the contacts of the detecting lever 115*a* of the new/old discrimination sensor 115 or by the breakage of the actuator 113. At this time of trouble, the new/old discrimination sensor 115 may detect that the developer cartridge 34 is always new.

Figure 21:
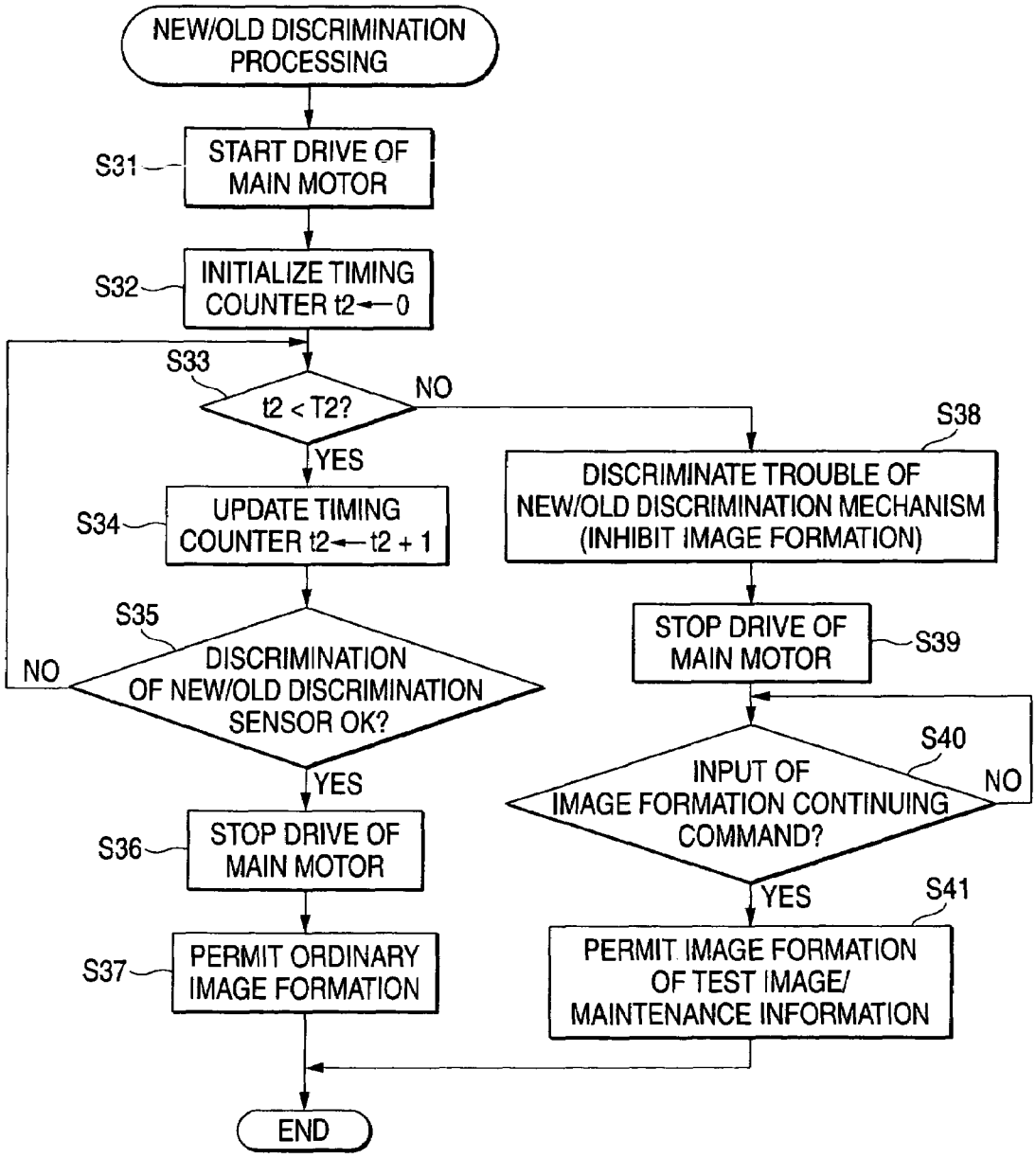
FIG. 21 is a flow chart showing a new/old discriminating operation.

In the new/old discriminating operation of the developer cartridge 34, as shown in FIG. 21, the drive of the main motor 200 is started at first at S31. At subsequent S32, a drive time measuring counter t2 of the main motor 200 is initialized to a value 0.

At subsequent S33, it is determined whether or not the value (i.e., the driving time period of the main motor 200) of the counter t2 is smaller than a set value T2 indicating the determination time period larger than the time period required for the abutment portion 82 of the new/old discrimination mechanism 112 to move from the new product position to the old production position after the process unit 21 was mounted in the body housing unit 30.

In the case of t2<T2, that is, in case the drive time period of the main motor 200 is shorter than the determination time period determined by the set value T2, the routine shifts to S34, at which the value of the counter t2 is incremented to update the drive time period of the main motor 200, and the routine shifts to S35.

At S35, it is determined whether or not the detection result by the new/old discrimination sensor 115 is normal. If the developer cartridge 34 mounted at this time is new, the detection result by the new/old discrimination sensor 115 changes from the new product to the new product. If the developer cartridge 34 mounted at this time is old, the detection result by the new/old discrimination sensor 115 is old. In case the detection result by the new/old discrimination sensor 115 is the old one from the beginning, it is determined at S35 that the new/old discrimination mechanism 112 normally operates, and the routine shifts to S36. At S36, moreover, the drive of the main motor 200 is stopped, and the ordinary printing operation is permitted at subsequent S37. After this, the new/old discriminating operation is ended.

In case it cannot be determined at S35 that the new/old discrimination mechanism 112 is normal, the routine shifts again to S33, at which the value of the counter t2 is smaller than the set value T2. In case it is determined at S33 that the value of the counter t2 exceeds the set value T2 and that the drive time period of the main motor 200 has reached the determination time period determined by the set value T2, the routine shifts to S38. At S38, the operation as the image formation inhibiting means for inhibiting the printing operation by the image forming unit 5 assuming that the new/old discrimination mechanism 112 fails and a new/old discrimination error occurs.

After the printing operation was thus inhibited at S38, the drive of the main motor 200 is stopped at S39. After this, at S40 it is determined by operating such ones of a plurality of keys disposed in the control unit 220 in a predetermined order as to input a predetermined image formation continuing command whether or not the image formation continuing command has been inputted. In this illustrative aspect, this determination of S40 functions, like the aforementioned determination of S20, as the determination unit of the invention.

When it is determined at S40 that the image formation continuing command has been inputted, the routine shifts to S41 to permit either the image formation based on the print data for the test image formation stored beforehand in the ROM 184, or the operation for permitting the image formation of the maintenance information designating the operation history or the prevailing state of the laser printer 1 stored in the RAM 186, thereby to end the spacing error detecting operation.

(3) Lifetime Deciding Process and Power Blocking Operation

The CPU 182 determines the new product in the new/old discriminating process thus far described and then counts the number of rotations of the developing roller 38 on the basis of the detection signal coming from the counter 197. When this counted number reaches a predetermined limit value, it is determined that the lifetime of the developer cartridge 34 mounted has elapsed. Here, the limit number is the number of the developing roller 38 till the so-called "faint printing", in which the charging performance of the toner agent of the new product is lowered by the agitation of the agitator 36 so that the toner agent cannot be transferred to the proper position of the sheet 3 after the operation to print an area of 5% was repeated for each sheet 3.

Moreover, the CPU 182 also judges the lapse of the lifetime of the developer cartridge 34 when it detects the toner shortage with the detection signals from the toner shortage detecting sensors 196. Moreover, the CPU 182 executes the printing operation at all times by applying the developing bias to the developing roller 38 from the power control unit 199 and the bias application circuit 198 (as referred to FIG. 12). When the CPU 182 determines the lapse of the lifetime of the developer cartridge 34 on the basis of the detections of the toner shortage detecting sensors 196 and the counter 197, it detects that the developer cartridge 34 is at the spaced position (as referred to FIG. 13) and then causes the power control unit 199 to feed the fusing current from the bias application circuit 198 thereby to fuse the fuse element 232. In short, the CPU 182 executes the "irreversible shielding operation".

As a result, the developing side electrode 231 and the bearing member 230 are electrically disconnected so that the developing bias is not applied to the developing roller 38. It is, therefore, possible to prevent the developer cartridge 34 exhausted from being erroneously mounted on another laser printer 1 of the same kind. This can prevents the sheet 3 having no toner transferred from being discharged, even if the printing operation is executed, thereby to suppress the image degradation due to the repeated use of the laser printer 1.

Here in the illustrative aspect, the CPU 182 also has a function to control the main motor 200 by lowering the speed of the developing roller 38, for the printing operation of a predetermined (e.g., several) number of sheets 3 after or before the lapse of the developer cartridge 34 is determined due to the toner shortage. As a result, the quantity of toner to be fed from the developing roller 38 to the photosensitive drum 99 can be reduced to cause the faint printing intensively. Therefore, the user can be informed beforehand of the fact that the toner has been exhausted so that the printing operations cannot be normally performed.

Second Illustrative Aspect

Figure 22:
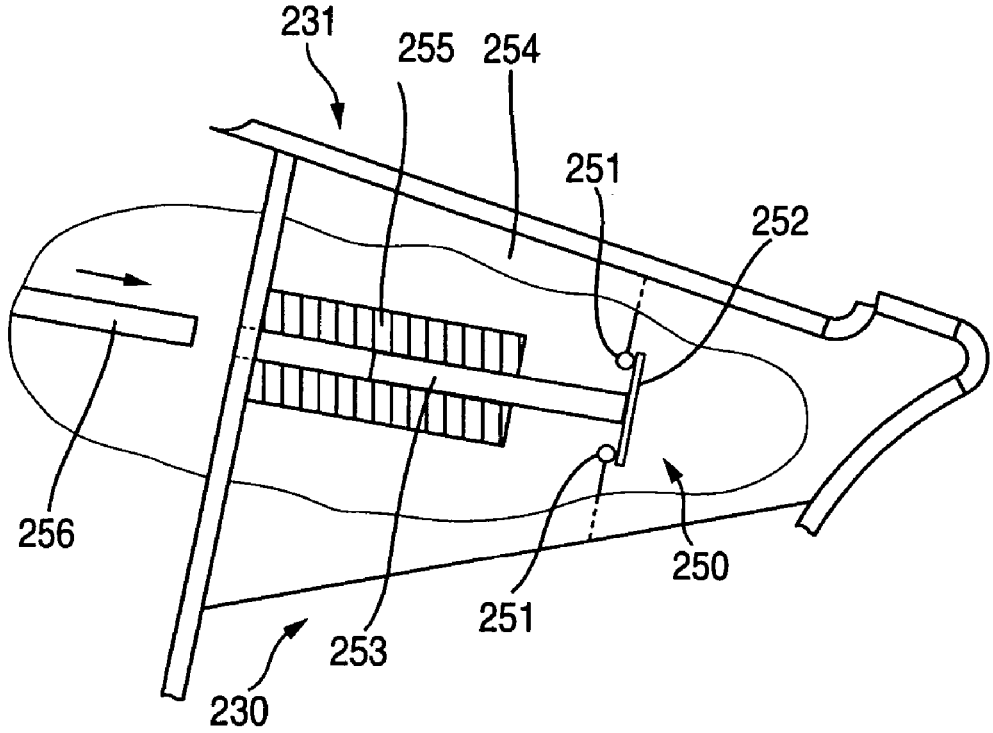
FIG. 22 is a configuration diagram of a mechanical switch portion according to a second illustrative aspect.

FIG. 22 shows second illustrative aspect. The second illustrative aspect is similar to first illustrative aspect excepting that the power supply shielding mechanism is exemplified by a mechanical switch 250. Therefore, the description of the overlapping portions is omitted by designating them by the same reference numerals as those of the first illustrative aspect, and the following description is made exclusively on the different portions As shown in FIG. 22, the power supply shielding mechanism of the illustrative aspect is the mechanical switch 250 connected between the bearing members 230 and the developing side electrode 231.

According to this configuration, the mechanical switch 250 is housed in a non-conductive casing member 254 between the bearing members 230 and the developing side electrode 231. The mechanical switch 250 is equipped with a pair of contacts 251 and 251 leading to the bearing members 230 and the developing side electrode 231, respectively, and a connection member 252 for connecting those two contacts 251 and 251 electrically. The connection member 252 is equipped on its back face with a bar-shaped pressed member 253, which is inserted into a cylindrical member 255 extending through the back wall of the non-conductive casing member 254.

On the side of the body frame 2, on the other hand, there is movably disposed a pressure member 256 for pushing the pressed member 253, when it advances into the cylindrical member 255, thereby to separate the connection member 252 from the two contacts 251 and 251. When it is determined that the lifetime of the developer cartridge 34 has elapsed, the pressure member 256 pushes the pressed member 253 thereby to execute the irreversible shielding operation.

With this configuration, the mechanical switch 250 once disconnected is covered with the non-conductive casing member 254 so that it cannot be easily connected thereby to suppress formation of a degraded image even if the exhausted developer cartridge 34 is used again.

Other Illustrative Aspects

The invention should not be limited to the illustrative aspects thus far described with reference to the drawings, but the following modes of illustrative aspect also falls within the scope of the present invention. Moreover, the present invention can be modified and embodied in various manners other than the following ones without departing from the gist thereof.

(1) In the configuration of the first illustrative aspect, the fusing current for shielding the fuse element 232 is fed through the developing side electrode 240, but may also be fed to the fuse element 232 through a dedicated electrode separately disposed.

(2) In the second illustrative aspect, the switching mechanism may also be configured into a keep solenoid switch for keeping the non-contact state so long as an inverse current is not fed.

(3) The electric shielding configuration by the fuse element 232 of First illustrative aspect and the electric shielding configuration by the mechanism switch 250 of Second illustrative aspect may also be combined.

(4) In the foregoing individual illustrative aspects, the lapse of the lifetime of the developer cartridge 34 is judged on the basis of the speed of the developing roller 38 but may also be judged on the basis of the speed of the photosensitive drum 99.

As described with reference to the illustrative aspects, there is provided an image forming apparatus and a developer cartridge having the following configurations.

(1) An image forming apparatus including: an image forming apparatus body that forms image on a recording medium; and a developer cartridge that is removably mounted on the image forming apparatus body, wherein the developer cartridge includes: a developer reserving chamber that reserves a developing agent; a developing side electrode that is configured to be applied with a developing bias; a developer carrier that carries a developing agent in the developer reserving chamber to an image carrier when the developing bias applied to the developing side electrode is received; and a power supply shielding mechanism that electrically connects the developing side electrode and the developer carrier and shields the power supply between the developing side electrode and the developer carrier by an irreversible shielding operation, and wherein the image forming apparatus body includes: a determination unit that determines whether or not a lifetime of the developer cartridge is elapsed; an application unit that applies the developing bias to the developing side electrode; and an execution unit that causes the power supply shielding mechanism to execute the shielding operation when the determination unit determines that the lifetime of the developer cartridge is elapsed.

Here, the "image forming apparatus" may be not only a printing apparatus such as a printer (e.g., a laser printer) but also a facsimile apparatus or a multifunction machine having a printer function and a scanner function.

The "image carrier" may be not only a photosensitive drum (or a photosensitive member) but also an intermediate transfer member. Moreover, the image carrier may also be disposed on the side of the developer cartridge or on the side of the image forming apparatus body.

(2) The image forming apparatus according to (1), wherein the power supply shielding mechanism includes a fuse element, and wherein the execution unit executes the shielding operation by feeding a fusing current to the fuse element.

(3) The image forming apparatus according to (2), wherein the execution unit feeds the fusing current to the fuse element through the developing side electrode.

(4) The image forming apparatus according to (3), further including: a displacement mechanism that displaces at least one of the image carrier and the developer carrier to be separatable with each other; a control unit that controls the displacement mechanism to allow the image carrier and the developer carrier to be in contact with each other when at an image forming operation and to allow the image carrier and the developer carrier to be separated with each other when at a non-image forming operation; and an earth electrode that contacts with the developer carrier in the state where the image carrier and the developer carrier are separated from each other, wherein the execution unit feeds the fusing current through the developing side electrode when at the non-image forming operation.

(5) The image forming apparatus according to (1), wherein the power supply shielding mechanism includes a switching mechanism that electrically connects and disconnects the developing side electrode and the developer carrier, and wherein the execution unit includes an actuator that operates the switching mechanism to electrically connect the developing side electrode and the developer carrier.

(6) The image forming apparatus according to (1), wherein the developer carrier includes a developing roller that rotates to feed the developing agent to the image carrier, wherein the determination unit includes a counter that counts a number of rotations of at least one of the developing roller and a photosensitive drum that acts as the image carrier and rotates in accordance with the rotation of the developing roller, and wherein the determination unit determines that the lifetime of the developer cartridge is elapsed when the number of rotations counted by the counter reaches a predetermined number.

(7) The image forming apparatus according to (6), wherein the determination unit includes a developer sensor that detects whether or not a residual amount of the developer in the developer reserving chamber is at a predetermined limitation amount or less, and wherein the determination unit determines that the lifetime of the developer cartridge is elapsed when the developer sensor detects that the residual amount of the developer is at the predetermined limitation amount or less, or when the number of rotations counted by the counter reaches a predetermined number.

(8) A developer cartridge that is removably mounted on an image forming apparatus body of an image forming apparatus, the developer cartridge including: a developer reserving chamber that reserves a developing agent; a developing side electrode that is configured to be applied with a developing bias; a developer carrier that carries a developing agent in the developer reserving chamber to an image carrier when the developing bias applied to the developing side electrode is received; and a power supply shielding mechanism that electrically connects the developing side electrode and the developer carrier and shields the power supply between the developing side electrode and the developer carrier by an irreversible shielding operation, wherein the power supply shielding mechanism performs the shielding operation when determined by the image forming apparatus body that a lifetime of the developer cartridge is elapsed.

(9) The developer cartridge according to (8), wherein the power supply shielding mechanism includes a fuse element that performs the shielding operation when determined by the image forming apparatus body that the lifetime of the developer cartridge is elapsed and a fusing current is fused by the image forming apparatus body.

(10) The developer cartridge according to (8), wherein the power supply shielding mechanism includes a switching mechanism that electrically connects and disconnects the developing side electrode and the developer carrier, the switching mechanism being configured to continuously disconnect the developing side electrode and the developer carrier when determined by the image forming apparatus body that the lifetime of the developer cartridge is elapsed.

According to the configurations of (1) and (8), the developer cartridge determined to have been exhausted is shielded from the power supply between the developing side electrode and the developer carrier by the power supply shielding mechanism. Therefore, even if the developer cartridge is erroneously mounted in another image forming apparatus body of the same kind, the developing bias is not applied to the developer carrier. It is possible to know that the exhausted developer cartridge has been mounted and to prevent an image of a degraded quality from being formed even if the exhausted developer cartridge is reused.

Incidentally, there can be conceived a configuration, in which the developer cartridge is equipped with an IC tag recorded with the information on the lifetime, so that the lapse of lifetime of the developer cartridge is determined. This configuration requires a device for resetting the information of the IC tag in case the developer cartridge is reused.

On the contrary to the above, according to the configurations of (2), (5), (9) and (10), the developer cartridge can be easily reused by replacing the fuse, by resetting the switching mechanism and by recharging the developing agent.

According to the configuration of (3), the configuration of the developer cartridge can be simplified by applying the developing bias and the fusing current of the fuse element through the common developing side electrode.

According to the configuration of (4), the developer carrier and the image carrier are made to contact at the time of the image forming operation but are spaced at the time of a non-image forming operation (e.g., a standby state before the start of the image formation). At this time of the image non-forming operation, moreover, the fusing current is fed between the developing side electrode and the developer carrier thereby to cause the fuse element to execute the shielding operation. Thus, the developing agent can be prevented from being transferred from the developer carrier to the image carrier by spacing the developer carrier and the image carrier in the standby state for the warming-up operation.

In the configuration of (6), the specific configuration of the determination unit is made such that the lapse of lifetime is determined in case the speed of the developing roller or the photosensitive drum reaches a preset limit number. In the configuration of (7), on the other hand, the lifetime lapse is also determined in case the developer residue in the developer reserving chamber becomes a limitation amount or less. The mode of the lifetime lapse of the developer cartridge is not limited to the shortage mode of the developer residue, in which the developer residue in the developer reserving chamber becomes so short that a sufficient developer cannot be fed to the image carrier. In another mode, even if the developing agent is sufficiently left, many developing operations are carried out to agitate the developing agent extremely in the developer reserving chamber, and the charging performance is lowered that normal images cannot be formed. Therefore, it is preferred to have the configuration of (7), because it can detect the lifetime lapse on the basis of the two modes.

The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspects were chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. An image forming apparatus comprising:

an image forming apparatus body that forms image on a recording medium; and a developer cartridge that is removably mounted on the image forming apparatus body, wherein the developer cartridge comprises:

a developer reserving chamber that reserves a developing agent;

a developing side electrode that is configured to be applied with a developing bias;

a developer carrier that carries a developing agent in the developer reserving chamber to an image carrier when the developing bias applied to the developing side electrode is received; and a power supply shielding mechanism that electrically connects the developing side electrode and the developer carrier and shields the power supply between the developing side electrode and the developer carrier by an irreversible shielding operation, and wherein the image forming apparatus body comprises:

a determination unit that determines whether or not a lifetime of the developer cartridge is elapsed;

an application unit that applies the developing bias to the developing side electrode; and an execution unit that causes the power supply shielding mechanism to execute the shielding operation when the determination unit determines that the lifetime of the developer cartridge is elapsed.

2. The image forming apparatus according to claim 1, wherein the power supply shielding mechanism includes a fuse element, and wherein the execution unit executes the shielding operation by feeding a fusing current to the fuse element.

3. The image forming apparatus according to claim 2, wherein the execution unit feeds the fusing current to the fuse element through the developing side electrode.

4. The image forming apparatus according to claim 3, further comprising:

a displacement mechanism that displaces at least one of the image carrier and the developer carrier to be separatable with each other;

a control unit that controls the displacement mechanism to allow the image carrier and the developer carrier to be in contact with each other when at an image forming operation and to allow the image carrier and the developer carrier to be separated with each other when at a non-image forming operation; and an earth electrode that contacts with the developer carrier in the state where the image carrier and the developer carrier are separated from each other, wherein the execution unit feeds the fusing current through the developing side electrode when at the non-image forming operation.

5. The image forming apparatus according to claim 1, wherein the power supply shielding mechanism includes a switching mechanism that electrically connects and disconnects the developing side electrode and the developer carrier, and wherein the execution unit includes an actuator that operates the switching mechanism to electrically connect the developing side electrode and the developer carrier.

6. The image forming apparatus according to claim 1, wherein the developer carrier includes a developing roller that rotates to feed the developing agent to the image carrier, wherein the determination unit includes a counter that counts a number of rotations of at least one of the developing roller and a photosensitive drum that acts as the image carrier and rotates in accordance with the rotation of the developing roller, and wherein the determination unit determines that the lifetime of the developer cartridge is elapsed when the number of rotations counted by the counter reaches a predetermined number.

7. The image forming apparatus according to claim 6, wherein the determination unit includes a developer sensor that detects whether or not a residual amount of the developer in the developer reserving chamber is at a predetermined limitation amount or less, and wherein the determination unit determines that the lifetime of the developer cartridge is elapsed when the developer sensor detects that the residual amount of the developer is at the predetermined limitation amount or less, or when the number of rotations counted by the counter reaches a predetermined number.

8. A developer cartridge that is removably mounted on an image forming apparatus body of an image forming apparatus, the developer cartridge comprising:

a developer reserving chamber that reserves a developing agent;

a developing side electrode that is configured to be applied with a developing bias;

a developer carrier that carries a developing agent in the developer reserving chamber to an image carrier when the developing bias applied to the developing side electrode is received; and a power supply shielding mechanism that electrically connects the developing side electrode and the developer carrier and shields the power supply between the developing side electrode and the developer carrier by an irreversible shielding operation, wherein the power supply shielding mechanism performs the shielding operation when determined by the image forming apparatus body that a lifetime of the developer cartridge is elapsed.

9. The developer cartridge according to claim 8, wherein the power supply shielding mechanism includes a fuse element that performs the shielding operation when determined by the image forming apparatus body that the lifetime of the developer cartridge is elapsed and a fusing current is fused by the image forming apparatus body.

10. The developer cartridge according to claim 8, wherein the power supply shielding mechanism includes a switching mechanism that electrically connects and disconnects the developing side electrode and the developer carrier, the switching mechanism being configured to continuously disconnect the developing side electrode and the developer carrier when determined by the image forming apparatus body that the lifetime of the developer cartridge is elapsed.

* * * * *